US010773518B2

(12) United States Patent
Sato et al.

(10) Patent No.: US 10,773,518 B2
(45) Date of Patent: Sep. 15, 2020

(54) LIQUID EJECTION APPARATUS

(71) Applicant: BROTHER KOGYO KABUSHIKI KAISHA, Nagoya-shi, Aichi-ken (JP)

(72) Inventors: Shoji Sato, Okazaki (JP); Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/172,008

(22) Filed: Oct. 26, 2018

(65) Prior Publication Data

US 2019/0126614 A1 May 2, 2019

(30) Foreign Application Priority Data

Nov. 2, 2017 (JP) ..... 2017-213049

(51) Int. Cl.
*B41J 25/00* (2006.01)
*B41J 2/045* (2006.01)
*B41J 11/00* (2006.01)

(52) U.S. Cl.
CPC ..... *B41J 2/04556* (2013.01); *B41J 11/008* (2013.01); *B41J 11/0095* (2013.01); *B41J 2202/15* (2013.01)

(58) Field of Classification Search
CPC ..... B41J 29/393
USPC ..... 347/8, 19, 16
See application file for complete search history.

(56) References Cited

U.S. PATENT DOCUMENTS 5,541,626 A * 7/1996 Hiramatsu ..... B41J 3/4078 347/8
2004/0008230 A1* 1/2004 Kelley ..... B41J 25/308 347/8
2004/0233244 A1* 11/2004 Elgee ..... B41J 11/006 347/19
2008/0238959 A1* 10/2008 Kato ..... B41J 29/38 347/8

(Continued)

FOREIGN PATENT DOCUMENTS

JP 2002-036525 A 2/2002
JP 2005-081750 A 3/2005

(Continued)

*Primary Examiner* — Lam S Nguyen
(74) *Attorney, Agent, or Firm* — Scully, Scott, Murphy & Presser, PC

(57) ABSTRACT

A conveyer conveys an ejection target in a conveyance direction along a conveyance path including a facing position facing a nozzle surface of a liquid ejection head. A distance sensor outputs a distance signal that changes depending on a distance between the nozzle surface and a surface of the ejection target. A controller performs: receiving the distance signal outputted from the distance sensor and positional information relating to a position of the ejection target on the conveyance path; and during ejecting liquid from the nozzle to record an image on the ejection target, changing at least one of a determination condition and a coefficient based on the positional information, the determination condition being a condition for determining whether to interrupt recording of the image by referring to the distance signal, the coefficient being multiplied by a value of the distance signal when determining whether to interrupt recording.

14 Claims, 19 Drawing Sheets

(56) References Cited

U.S. PATENT DOCUMENTS

2013/0257937 A1* 10/2013 Arakane ..... B41J 11/001
347/8

FOREIGN PATENT DOCUMENTS

JP 2010-173150 A 8/2010
JP 2012-131138 A 7/2012

* cited by examiner

LIQUID EJECTION APPARATUS

CROSS REFERENCE TO RELATED APPLICATIONS

This application claims priority from Japanese Patent Application No. 2017-213049 filed Nov. 2, 2017. The entire content of the priority application is incorporated herein by reference.

TECHNICAL FIELD

This disclosure relates to a liquid ejection apparatus.

BACKGROUND

There is a known problem in which when an ejection target comes into contact with a nozzle surface, a nozzle formed on the nozzle surface is damaged, and a liquid ejection performance from the nozzle is deteriorated. To prevent this problem, proposed is to perform processing to detect a distance between a surface of the ejection target and the nozzle surface by a sensor, and adjust the distance when the ejection target is determined to be likely to come into contact with the nozzle surface based on detection results.

SUMMARY

According to one aspect, this specification discloses a liquid ejection apparatus. The liquid ejection apparatus includes a liquid ejection head, a conveyer, a distance sensor, and a controller. The liquid ejection head has a nozzle surface formed with a nozzle configured to eject liquid. The conveyer is configured to convey an ejection target in a conveyance direction along a conveyance path including a facing position facing the nozzle surface. The distance sensor is configured to output a distance signal that changes depending on a distance between the nozzle surface and a surface of the ejection target. The controller is configured to perform: receiving the distance signal outputted from the distance sensor and positional information relating to a position of the ejection target on the conveyance path; and during ejecting liquid from the nozzle to record an image on the ejection target, changing at least one of a determination condition and a coefficient based on the positional information, the determination condition being a condition for determining whether to interrupt recording of the image by referring to the distance signal, the coefficient being multiplied by a value of the distance signal when determining whether to interrupt recording.

According to another aspect, this specification also discloses a liquid ejection apparatus. The liquid ejection apparatus includes a liquid ejection head, a conveyer, a distance sensor, and a controller. The liquid ejection head has a nozzle surface formed with a nozzle configured to eject liquid. The conveyer is configured to convey an ejection target in a conveyance direction along a conveyance path including a facing position facing the nozzle surface. The distance sensor is configured to output a distance signal that changes depending on a distance between the nozzle surface and a surface of the ejection target. The controller is configured to perform: receiving the distance signal outputted from the distance sensor and positional information relating to a position of the ejection target on the conveyance path; and during ejecting liquid from the nozzle to record an image on the ejection target, when the positional information satisfies a particular condition, performing distance detection of detecting the distance by referring to the distance signal and of interrupting image recording depending on a result of the distance detection, and when the positional information does not satisfy the particular condition, not performing the distance detection.

BRIEF DESCRIPTION OF THE DRAWINGS

Embodiments in accordance with this disclosure will be described in detail with reference to the following figures wherein.

DETAILED DESCRIPTION

A degree of approach of the ejection target to the nozzle surface and a degree of damage on the nozzle when the ejection target comes into contact with the nozzle surface may change depending on a position of the ejection target in a conveyance path. However, this is not described in the above. Therefore, in the technology described above, even when the ejection target is less likely to come into contact with the nozzle surface or the degree of damage on the nozzle when the ejection target comes into contact with the nozzle surface is low, the ejection target is determined to be likely to come into contact with the nozzle surface, and processing to adjust the distance may be performed. In this case, by this processing, image recording may be interrupted and the throughput of the liquid ejection apparatus may be degraded.

An example of an object of this disclosure is to provide a liquid ejection apparatus configured to suppress throughput degradation by performing appropriate processing depending on a position of an ejection target in a conveyance path.

First Embodiment

Figure 1:
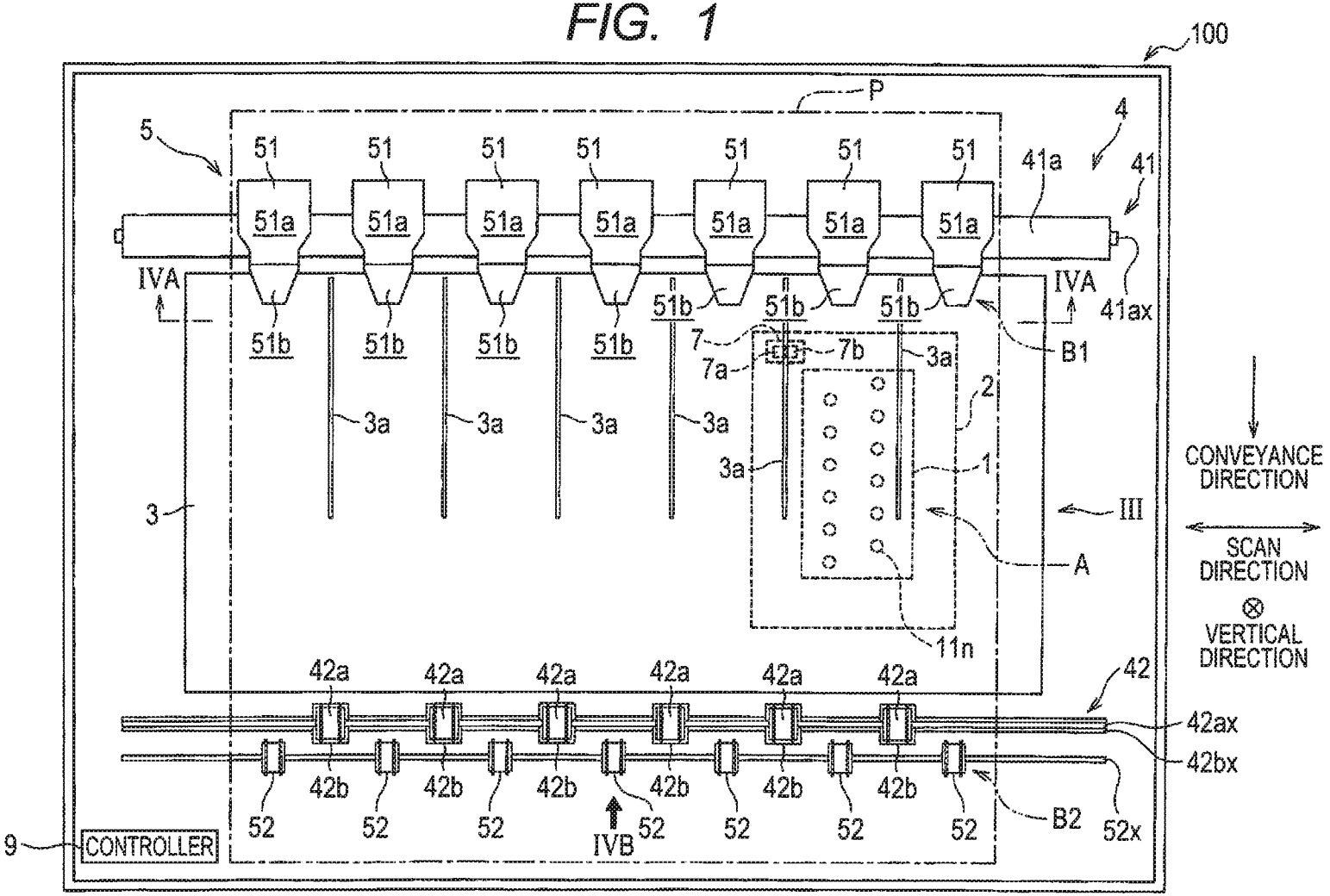
FIG. 1 is a plan view of a printer according to a first embodiment of this disclosure.

As shown in FIG. 1, a printer 100 according to a first embodiment of this disclosure includes a head 1, a carriage 2, a platen 3, a conveyer (conveyance mechanism) 4, a corrugation imparting mechanism 5, an optical sensor 7, and a controller 9.

The head 1 is a serial type, and is mounted on the carriage 2, and is configured to reciprocate together with the carriage 2 in a scan direction (perpendicular direction perpendicular to the conveyance direction). The carriage 2 is supported by a carriage movement mechanism (not illustrated). When a carriage motor 25 (refer to FIG. 5) is driven by control of the controller 9, the carriage movement mechanism is driven and the carriage 2 moves in the scan direction while supporting the head 1.

Figure 2:
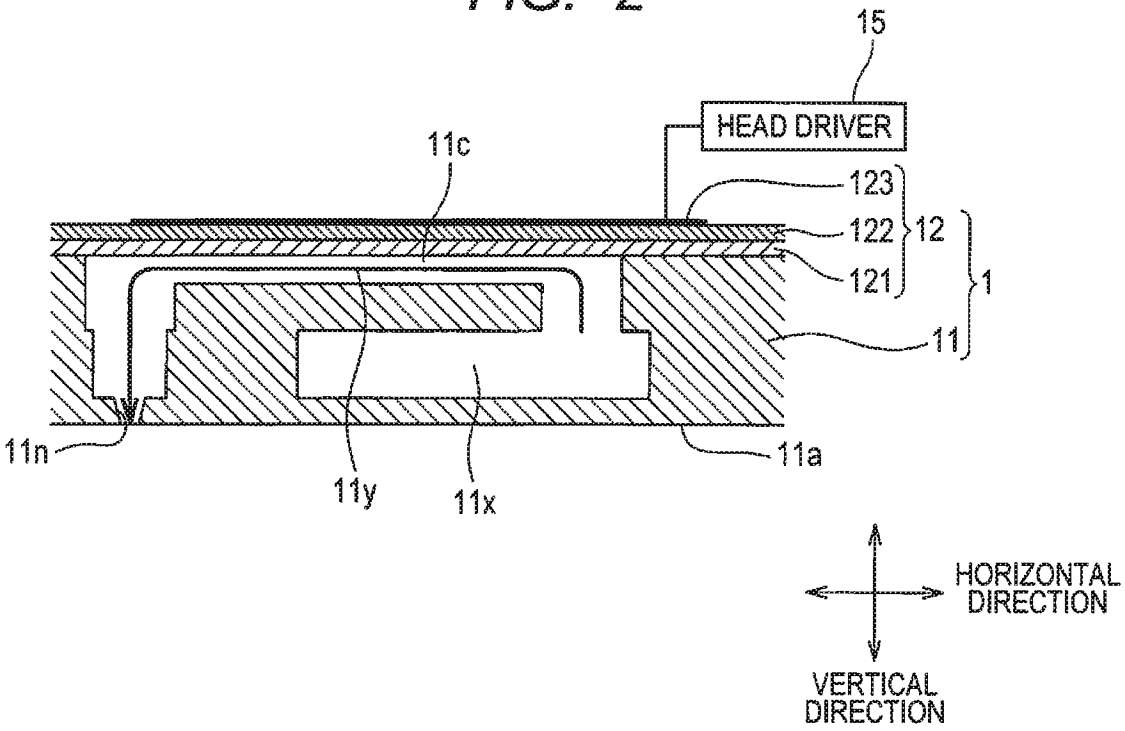
FIG. 2 is a partial sectional view of a head included in the printer according to the first embodiment of this disclosure.

As shown in FIG. 2, the head 1 includes a channel unit 11 and an actuator unit 12. A lower surface of the channel unit 11 is a nozzle surface 11*a* on which a plurality of nozzles 11*n* are formed. Inside the channel unit 11, a common channel 11*x* communicating with an ink tank (not illustrated) and individual channels 11*y* individually provided for the respective nozzles 11*n* are formed. The individual channels 11*y* are channels from an outlet of the common channel 11*x* to the nozzles 11*n* through pressure chambers 11*c*. In an upper surface of the channel unit 11, a plurality of pressure chambers 11*c* is opened. The actuator unit 12 includes a vibration plate 121 disposed on an upper surface of the channel unit 11 so as to cover the plurality of pressure chambers 11*c*, a piezoelectric layer 122 disposed on an upper surface of the vibration plate 121, and a plurality of individual electrodes 123 disposed on an upper surface of the piezoelectric layer 122 so as to respectively face the plurality of pressure chambers 11*c*. In the vibration plate 121 and the piezoelectric layer 122, portions sandwiched by the respective individual electrodes 123 and the respective pressure chambers 11*c* function as individual unimorph actuators for each pressure chamber 11*c*, and independently deformable according to application of a voltage by a head driver 15 to each individual electrode 123. By deformation of the actuator so as to become convex toward the pressure chamber 11*c*, a volume of the pressure chamber 11*c* decreases, ink inside the pressure chamber 11*c* is pressurized, and the ink is ejected from the nozzle 11*n*.

Figure 3:
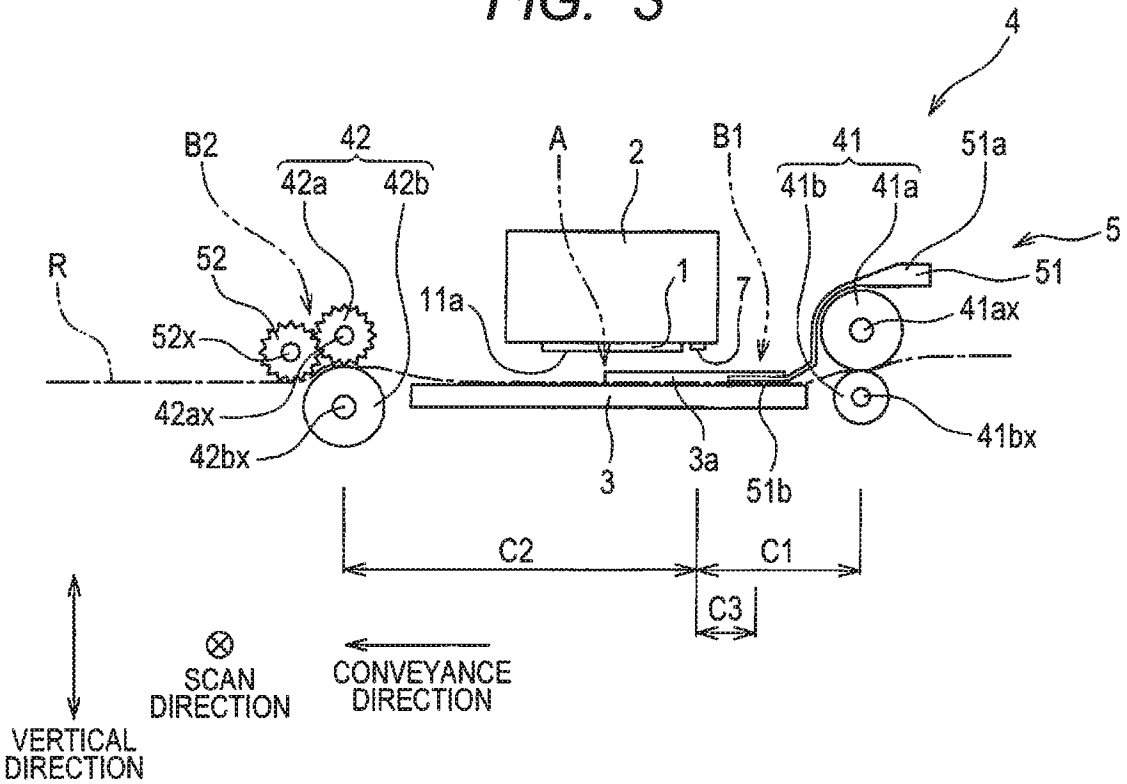
FIG. 3 is a side view of the printer according to the first embodiment of this disclosure, viewed from the direction of the arrow III in FIG. 1.

As shown in FIG. 3, the platen 3 is disposed below the head 1 and the carriage 2. On a surface of the platen 3, a paper P is supported.

As shown in FIG. 1, the conveyer 4 includes an upstream roller pair 41 disposed at an upstream side of the head 1 in the conveyance direction, and downstream roller pairs 42 disposed at a downstream side of the head 1 in the conveyance direction.

As shown in FIG. 3, the upstream roller pair 41 includes an upper roller 41*a* and a lower roller 41*b*. Both of the upper roller 41*a* and the lower roller 41*b* are long in the scan direction, and are disposed one above the other so that their circumferential surfaces come into contact with each other. The upper roller 41*a* and the lower roller 41*b* are respectively supported by shafts 41*ax* and 41*bx* extending in the scan direction, and rotatable around the shafts 41*ax* and 41*bx*.

As shown in FIG. 1, the downstream roller pairs 42 include six upper rollers 42*a* and six lower rollers 42*b*. Each one of the upper rollers 42*a* and each one of the lower rollers 42*b* are paired and disposed one above the other so that their circumferential surfaces come into contact with each other. That is, the downstream roller pairs 42 include six pairs each consisting of one upper roller 42*a* and one lower roller 42*b*. The six pairs are arranged at even intervals in the scan direction. The six upper rollers 42*a* are supported by a shaft 42*ax* extending in the scan direction, and rotatable around the shaft 42*ax*. The six lower rollers 42*b* are supported by a shaft 42*bx* extending in the scan direction, and rotatable around the shaft 42*bx*.

When a conveyance motor 45 (refer to FIG. 5) is driven by control of the controller 9, one of the upper roller and the lower roller of each roller pair 41, 42 is driven, and the other one of the upper roller and the lower roller of each roller pair 41, 42 follows. Then, by rotating the upper rollers and the lower rollers of the respective roller pairs 41 and 42 while sandwiching the paper P, the paper P is conveyed in the conveyance direction along a conveyance path R (refer to FIG. 3) including a facing position A on the surface of the platen 3 facing the nozzle surface 11*a* so as to pass through the facing position A. The conveyance path R extends from a paper feed tray (not illustrated) to a discharge tray (not illustrated) through the facing position A. The conveyance direction is a direction from the paper feed tray (not illustrated) toward the facing position A.

The upper roller 41*a* and the lower roller 41*b* of the upstream roller pair 41 and the lower rollers 42*b* of the downstream roller pairs 42 are rubber rollers having no projection formed on an outer circumferential surface, however, the upper rollers 42*a* of the downstream roller pairs 42 are spur rollers each having a plurality of projections formed on an outer circumferential surface. Accordingly, ink that has landed on a surface of the paper P does not tend to attach to the upper rollers 42*a*.

As shown in FIG. 1, the corrugation imparting mechanism 5 includes seven corrugation plates 51, six ribs 3*a* formed on the surface of the platen 3, seven corrugation spurs 52, and six pairs each consisting of one upper roller 42*a* and one lower roller 42*b* in the downstream roller pairs 42.

The seven corrugation plates 51 press the surface of the paper P at a pressing position B1 set at an upstream side of the head 1 in the conveyance direction and at a downstream side of the upstream roller pair 41 in the conveyance direction. That is, the corrugation plates 51 are an example of "pressing member." As shown in FIG. 1, the seven corrugation plates 51 are arranged at even intervals in the scan direction. As shown in FIG. 3, each corrugation plate 51 includes a base portion 51*a* provided above the upper roller 41*a* of the upstream roller pair 41, and a pressing portion 51*b* extending downstream from the base portion 51*a* in the conveyance direction and facing a surface of an upstream portion of the platen 3 in the conveyance direction. The pressing portion 51*b* faces the surface of the platen 3 through a slight gap.

As shown in FIG. 1, the six ribs 3*a* are arranged at even intervals in the scan direction and respectively disposed between corrugation plates 51 adjacent to each other in the scan direction. Each rib 3*a* extends in the conveyance direction. Positions in the scan direction of the six ribs 3*a* respectively match positions in the scan direction of the pairs each consisting of one upper roller 42*a* and one lower roller 42*b*.

Figure 4A:
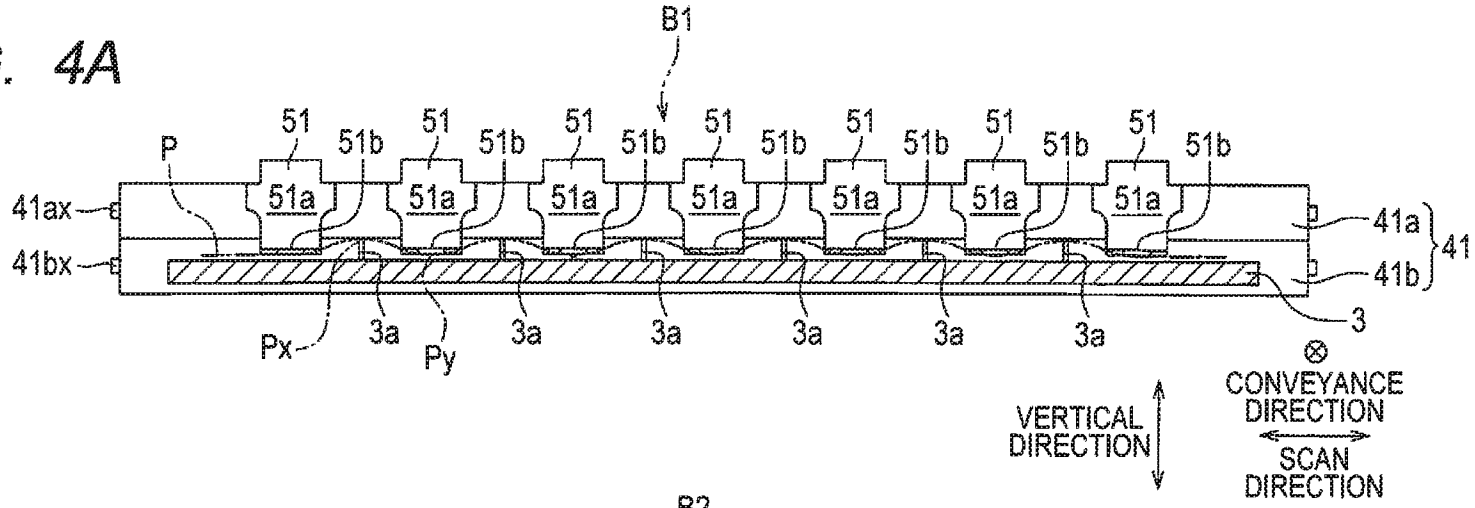
FIG. 4A is a sectional view taken along line IVA-IVA in FIG. 1.

As shown in FIG. 4A, an upper end of each rib 3*a* is positioned higher than the pressing portion 51*b* of each corrugation plate 51. In this positional relationship, by supporting the paper P by the upper ends of the six ribs 3*a* from below and pressing the paper P by the pressing portions 51*b* of the seven corrugation plates 51 from above, a corrugation along the scan direction is imparted to the paper P. In detail, a corrugation including a plurality of mountain portions Px close to the nozzle surface 11*a* and a plurality of valley portions Py farther spaced from the nozzle surface 11*a* than the mountain portions Px, respectively arranged along the scan direction, is imparted to the paper P.

The seven corrugation spurs 52 press the surface of the paper P at a pressing position B2 set at a downstream side of the head 1 in the conveyance direction. As shown in FIG. 1, the seven corrugation spurs 52 are disposed at a downstream side of the downstream roller pairs 42 in the conveyance direction. The seven corrugation spurs 52 are arranged at even intervals in the scan direction, and their positions in the scan direction respectively match positions in the scan direction of the seven corrugation plates 51. Between the corrugation spurs 52 adjacent to each other in the scan direction, pairs each consisting of one upper roller 42*a* and one lower roller 42*b* are respectively disposed. The seven corrugation spurs 52 are supported by a shaft 52*x* extending in the scan direction, and are rotatable around the shaft 52*x*.

Figure 4B:
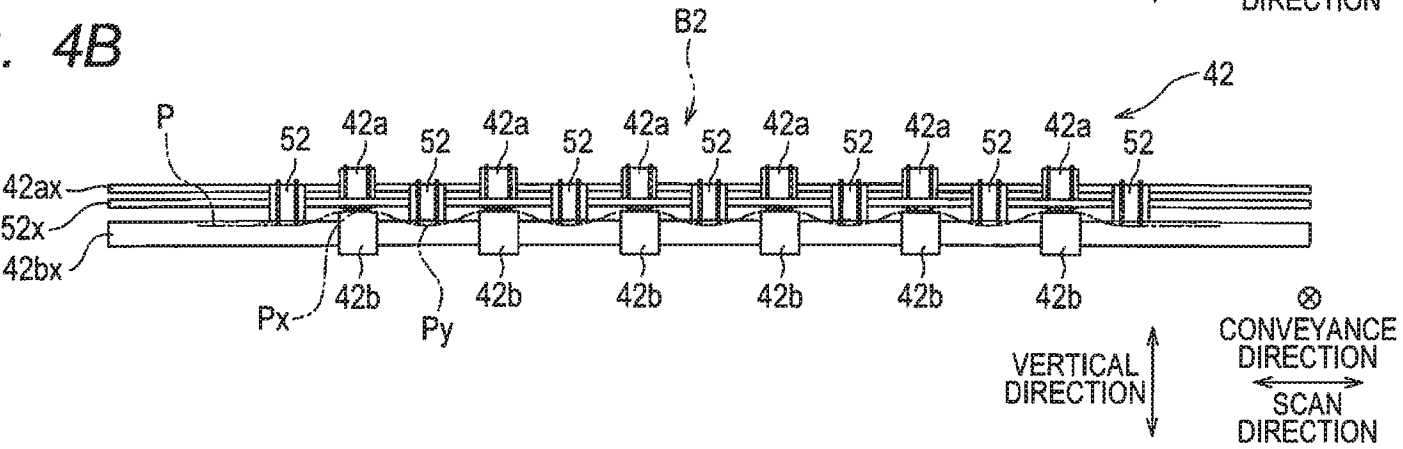
FIG. 4B is a side view viewed from the direction of the arrow IVB in FIG. 1.

As shown in FIG. 4B, a contact point between the upper roller 42*a* and the lower roller 42*b* is positioned higher than the lower end of the corrugation spur 52. In this positional relationship, the six lower rollers 42*b* support the paper P from below, and the seven corrugation spurs 52 press the paper P from above, and accordingly, a corrugation along the scan direction is imparted to the paper P. In detail, a corrugation including a plurality of mountain portions Px and a plurality of valley portions Py respectively arranged along the scan direction, similar to the corrugation (refer to FIG. 4A) imparted at the pressing position B1, is imparted to the paper P.

By imparting the corrugation along the scan direction to the paper P by the corrugation imparting mechanism 5, the paper P is provided with stiffness, and excellent conveyance is realized.

As shown in FIG. 1, the optical sensor 7 is mounted on the carriage 2, and disposed at an upstream side of the head 1 in the conveyance direction and at one side of the scan direction. The optical sensor 7 is used for distance detection to detect a distance between the surface of the paper P and the nozzle surface 11*a*. The optical sensor 7 is a reflective optical sensor, and includes a light emission element 7*a* and a light reception element 7*b*. The light emission element 7*a* emits light by control of the controller 9. Light emitted by the light emission element 7*a* is reflected by the surface of the platen 3 or the surface of the paper P. The light reception element 7*b* receives light reflected on the surface of the platen 3 or the surface of the paper P, and outputs an output signal based on the light. As described later, the output signal to be output by the light reception element 7*b* changes according to the distance described above. That is, an output signal output by the light reception element 7*b* is an example of "distance signal," and the optical sensor 7 is an example of "distance sensor."

As shown in FIG. 3, an interval C1 between the upstream roller pair 41 and the optical sensor 7 in the conveyance direction and an interval C3 between the pressing position B1 and the optical sensor 7 in the conveyance direction are smaller than an interval C2 between the downstream roller pairs 42 and the optical sensor 7 in the conveyance direction (C2>C1>C3). All nozzles formed on the nozzle surface 11*a* are disposed at a downstream side of the optical sensor 7 in the conveyance direction.

Ink to be ejected from the nozzles 11*n* is not a pigment ink, but a dye ink. In the case of a pigment ink, a difference in reflected light amount between a region in which the ink is landed and a region in which the ink is not landed on the paper P is large, and it becomes difficult to perform distance detection during recording. On the other hand, in the case of a dye ink, the above-described difference is smaller than in the case of a pigment ink, and it is possible to perform distance detection during recording.

Figure 5:
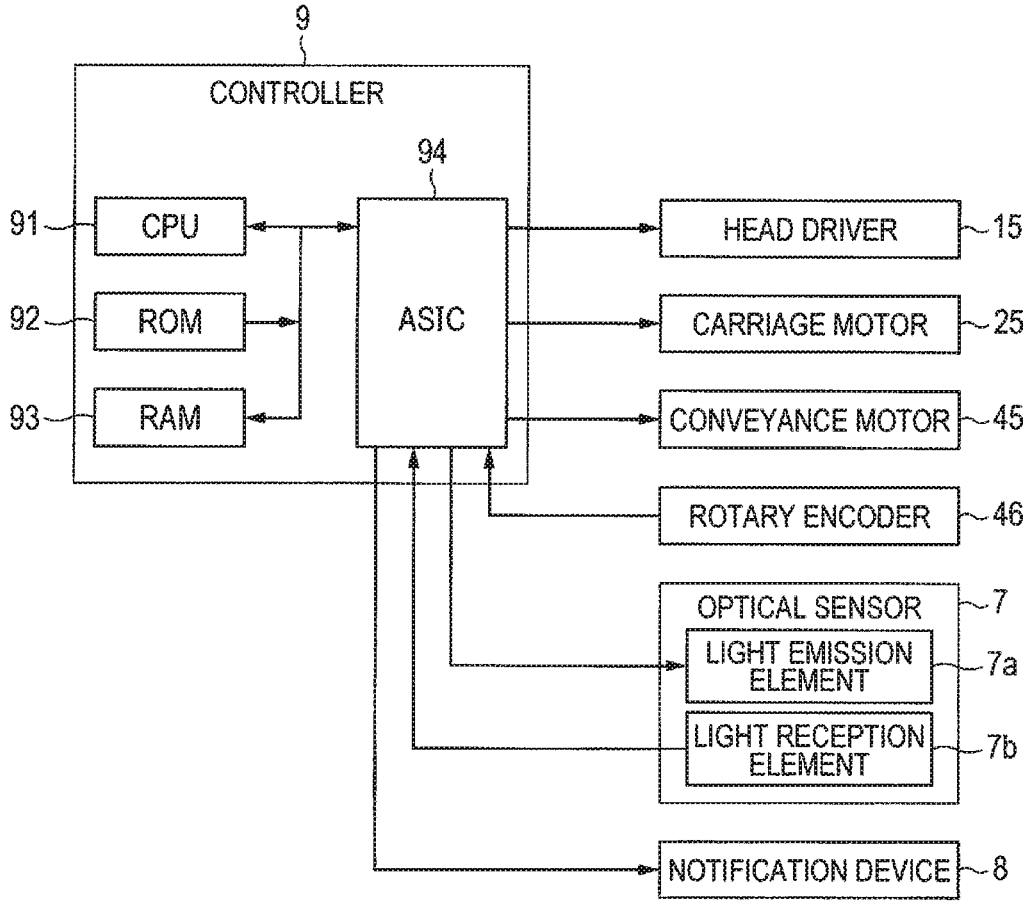
FIG. 5 is a block diagram showing an electrical configuration of the printer according to the first embodiment of this disclosure.

As shown in FIG. 5, the controller 9 includes a CPU (Central Processing Unit) 91, a ROM (Read Only Memory) 92, a RAM (Random Access Memory) 93, and an ASIC (Application Specific Integrated Circuit) 94 including various control circuits. The controller 9 is connected to an external apparatus such as a PC to perform data communication.

In the ROM 92, programs and data to be used by the CPU 91 to control various operations are stored. The RAM 93 temporarily stores data to be used by the CPU 91 to execute the above-described programs. The CPU 91 issues a command to the ASIC 94 according to programs and data stored in the ROM 92 and the RAM 93 based on a recording command input from an external apparatus. The CPU 91 and the ASIC 94 are examples of "controller."

The head driver 15, the carriage motor 25, and the conveyance motor 45 are connected to the ASIC 94. According to a command from the CPU 91, the ASIC 94 controls the head driver 15, the carriage motor 25, and the conveyance motor 45 to alternately perform a conveyance operation to convey the paper P by a particular distance in the conveyance direction by the conveyer 4, and an ejection operation to eject ink from the nozzles 11*n* while moving the carriage 2 in the scan direction. Accordingly, on the surface of the paper P, ink dots are formed and an image is recorded.

A rotary encoder 46 that outputs a signal showing a number of rotations of the conveyance motor 45 is further connected to the ASIC 94. The ASIC 94 receives a signal output from the rotary encoder 46, and transfers this signal to the CPU 91. The CPU 91 detects a position of the paper P in the conveyance path R based on the signal. In this way, the rotary encoder 46 outputs a signal relating to a position of the paper P in the conveyance path R. That is, a signal output by the rotary encoder 46 is an example of "position signal" (one of "positional information"), and the rotary encoder 46 is an example of "position sensor."

The optical sensor 7 is further connected to the ASIC 94. According to a command from the CPU 91, the ASIC 94 inputs an input signal into the light emission element 7*a* to irradiate light from the light emission element 7*a*. In addition, the ASIC 94 receives an output signal output from the light reception element 7*b* and transfers this signal to the CPU 91. The CPU 91 performs distance detection based on the output signal from the light reception element 7*b*.

A notification device 8 (for example, a speaker, a display, and so on) to output a notification to a user is further connected to the ASIC 94. According to a command from the CPU 91, the ASIC 94 transmits a notification signal to the notification device 8 to make the notification device 8 output a notification to a user (for example, sound output by a speaker, image display on a display).

Here, input-output characteristics of the optical sensor 7 are described with reference to FIG. 6.

Figure 6:
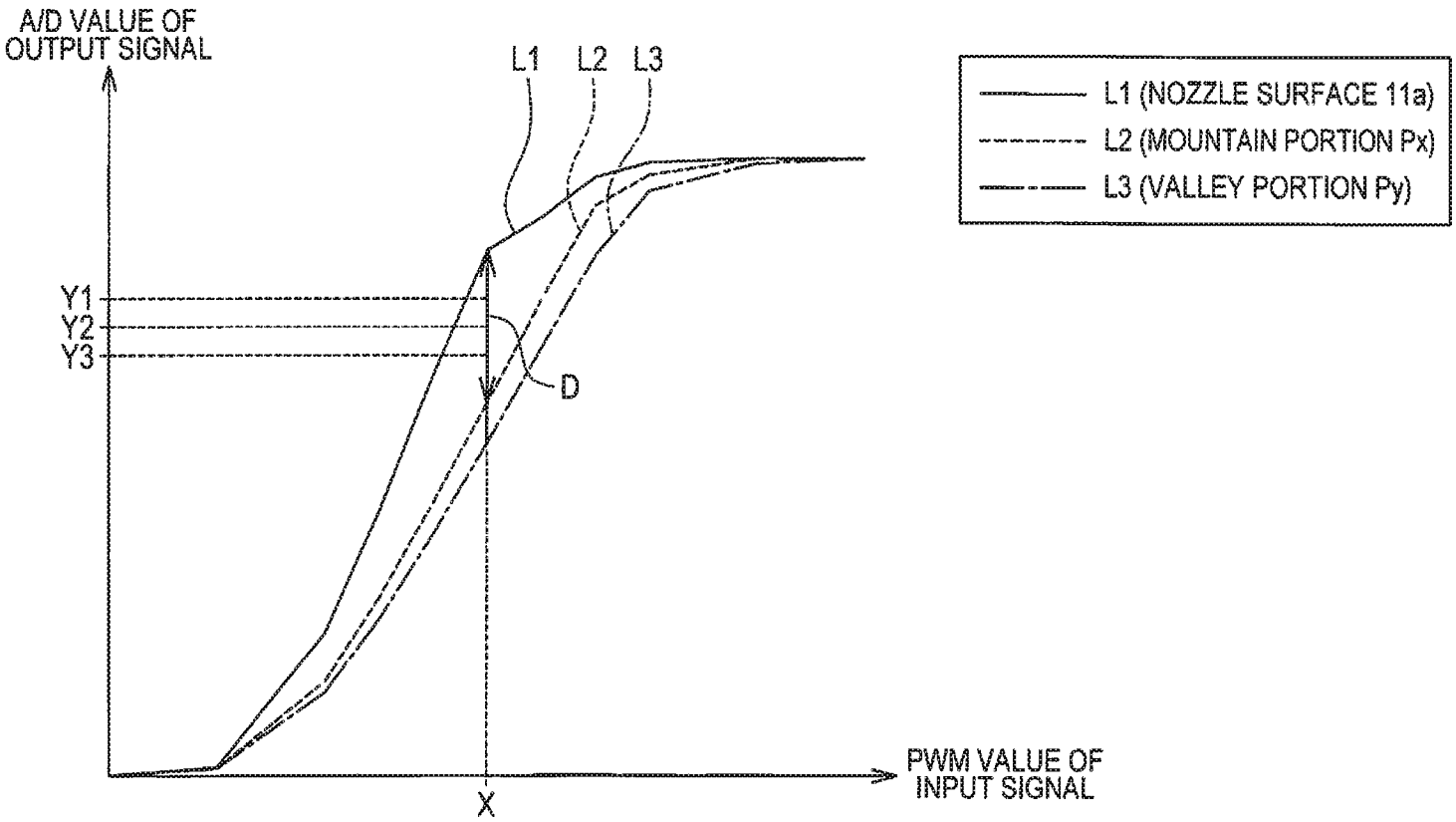
FIG. 6 is a graph showing an example of input-output characteristics of an optical sensor according to the first embodiment of this disclosure.

In FIG. 6, the horizontal axis represents a PWM (Pulse Width Modulation) value of an input signal to be input into the light emission element 7*a*, and the vertical axis represents an A/D (Analog/Digital) value of an output signal to be output from the light reception element 7*b*. A light emission amount being an amount of light emitted by the light emission element 7*a* is in proportion to the PWM value of the input signal, and the light emission amount increases as the PWM value increases. The CPU 91 and the ASIC 94 are configured so as to change the light emission amount by changing the PWM value of the input signal to be input into the light emission element 7*a*.

The curves L1 to L3 in FIG. 6 show relationships between the PWM value of the input signal and the A/D value of the output signal when the light emission element 7*a* irradiates light toward the surface of the paper P in response to the input signal and the light reception element 7*b* receives light reflected on the surface of the paper P and outputs the output signal, on condition that a paper P of a standard kind is used and a height of the surface of the paper P is set to the heights of the nozzle surface 11*a*, the mountain portion Px, and the valley portion Py, respectively. In the order of the nozzle surface 11*a*, the mountain portion Px, and the valley portion Py, the height in the vertical direction becomes lower, and a distance between the surface of the paper P and the nozzle surface 11*a* (referred to as "paper-nozzle distance") when the paper P is located at the height becomes longer. In FIG. 6, at the same PWM value, the A/D value decreases as the paper-nozzle distance increases (that is, in the order of the curve L1, the curve L2, and the curve L3).

To perform accurate distance detection, an amount of change in output signal caused by a difference in height of the surface of the paper P (that is, in response to a change in distance between the surface of the paper P and the nozzle surface 11*a*) is preferably large. A large amount of change in output signal according to a distance change means high sensitivity of distance detection. In the present embodiment, a PWM value when the difference (amount of change) in A/D value between the curves L1 and L2 becomes a maximum D is defined as an input setting value X for distance detection. In addition, three values between the A/D value in the curve L1 and the A/D value in the curve L2 at the input setting value X are defined as thresholds Y1 to Y3 (Y1>Y2>Y3).

The data in FIG. 6 is based on characteristics unique to each optical sensor 7, and are obtained by actual measurement in the manufacturing process of the printer 100. Among these data, the input setting value X and the thresholds Y1 to Y3 are stored in the ROM 92 in the manufacturing process of the printer 100. The input setting value X is used in distance detection. The thresholds Y1 to Y3 are used for determination as to whether to interrupt image recording (recording interruption determination processing: refer to FIG. 8), together with results of distance detection. That is, the thresholds Y1 to Y3 are examples of "determination conditions."

Next, control details relating to recording are described with reference to FIG. 7.

First, the CPU 91 determines whether it has received a recording command from an external apparatus (S1). When the CPU 91 does not receive a recording command (S1: NO), the processing of S1 is repeated. When the CPU 91 receives a recording command (S1: YES), the CPU 91 controls the conveyance motor 45 through the ASIC 94 to start conveyance of the paper P (S2).

After S2, the CPU 91 determines whether a leading edge (downstream end in the conveyance direction) of the paper P has reached the upstream roller pair 41 based on a signal of the rotary encoder 46 transferred from the ASIC 94 (S3). When the leading edge of the paper P does not reach the upstream roller pair 41 (S3: NO), the processing of S3 is repeated. When the leading edge of the paper P reaches the upstream roller pair 41 (S3: YES), the CPU 91 sets the threshold to Y2 (S4).

After S4, the CPU 91 controls the carriage motor 25 through the ASIC 94 to start movement of the carriage 2, and starts distance detection (S5). When starting distance detection, the CPU 91 inputs an input signal with a PWM value set to the input setting value X into the light emission element 7*a* through the ASIC 94, and controls the light emission element 7*a* to start light emission. Then, the CPU 91 performs distance detection based on an output signal from the light reception element 7*b*. During distance detection, the CPU 91 performs recording interruption determination processing (refer to FIG. 8) described later.

After S5, the CPU 91 determines whether the leading edge of the paper P has reached the facing position A based on a signal of the rotary encoder 46 transferred from the ASIC 94 (S6). When the leading edge of the paper P does not reach the facing position A (S6: NO), the processing of S6 is repeated. When the leading edge of the paper P reaches the facing position A (S6: YES), the CPU 91 controls the respective sections of the printer 100 so as to start recording on the paper P (S7). In detail, the CPU 91 controls the head driver 15, the carriage motor 25, and the conveyance motor 45 through the ASIC 94 to alternately perform a conveyance operation to convey the paper P by a particular distance in the conveyance direction by the conveyer 4, and an ejection operation to eject ink from the nozzles 11*n* while moving the carriage 2 in the scan direction.

After S7, the CPU 91 determines whether the leading edge of the paper P has reached the downstream roller pairs 42 based on a signal of the rotary encoder 46 transferred from the ASIC 94 (S8). When the leading edge of the paper P does not reach the downstream roller pairs 42 (S8: NO), the processing of S8 is repeated. When the leading edge of the paper P reaches the downstream roller pairs 42 (S8: YES), the CPU 91 sets the threshold to Y3 (S9).

After S9, the CPU 91 determines whether a trailing edge (upstream end in the conveyance direction) of the paper P has reached the upstream roller pair 41 based on a signal of the rotary encoder 46 transferred from the ASIC 94 (S10). When the trailing edge of the paper P does not reach the upstream roller pair 41 (S10: NO), the processing of S10 is repeated. When the trailing edge of the paper P reaches the upstream roller pair 41 (S10: YES), the CPU 91 sets the threshold to Y1 (S11).

After S11, the CPU 91 determines whether to finish recording on the paper P (S12). When unrecorded image data is left in the RAM 93, the CPU 91 determines that recording on the paper P is not to be finished (S12: NO), and repeats the processing of S12. When unrecorded image data is not left in the RAM 93, the CPU 91 determines that recording on the paper P is to be finished (S12: YES), returns the carriage 2 to a standby position, and ends the distance detection (S13). The standby position of the carriage 2 is located at one end in the scan direction in the movable region of the carriage 2, and is a position at which the nozzle surface 11*a* does not face the surface of the platen 3. When ending the distance detection, the CPU 91 stops input of the input signal into the light emission element 7*a*. The CPU 91 also ends recording interruption determination processing (refer to FIG. 8) along with ending of the distance detection. After S13, the CPU 91 ends this routine.

To successively record images on a plurality of sheets P, the CPU 91 ends recording on one paper P (S12: YES), returns the carriage 2 to the standby position and ends the distance detection (S13), and returns the process to S2 and repeats the processing of S2 to S13 until recording on all sheets P is finished.

Figure 8:
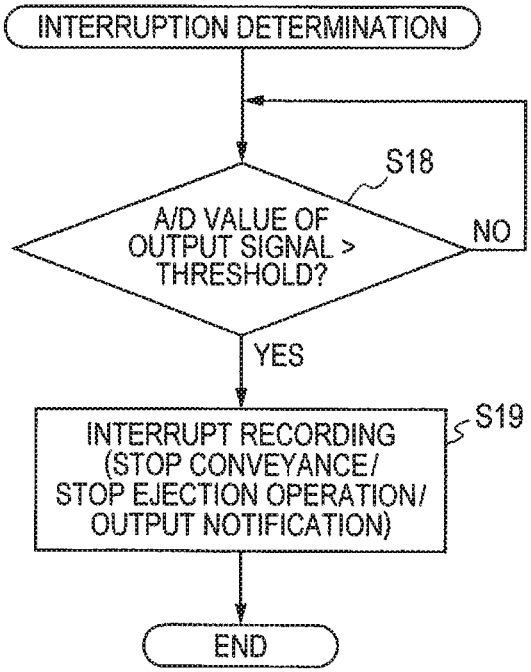
FIG. 8 is a flowchart showing recording interruption determination processing in the first embodiment of this disclosure.

Next, with reference to FIG. 8, recording interruption determination processing is described.

First, the CPU 91 determines whether an A/D value of an output signal received from the light reception element 7*b* has exceeded a set threshold (S18). When the A/D value does not exceed the threshold (S18: NO), the processing of S18 is repeated.

When the A/D value exceeds the threshold (S18: YES), the CPU 91 determines to interrupt image recording (S19). In detail, in S19, the CPU 91 performs processing to stop conveyance of the paper P by the conveyer 4 by controlling the conveyance motor 45 through the ASIC 94, processing to stop an ejection operation by controlling the carriage motor 25 through the ASIC 94, and processing to output a notification to a user by controlling the notification device 8 through the ASIC 94. After S19, the CPU 91 ends this routine.

Figure 9A:
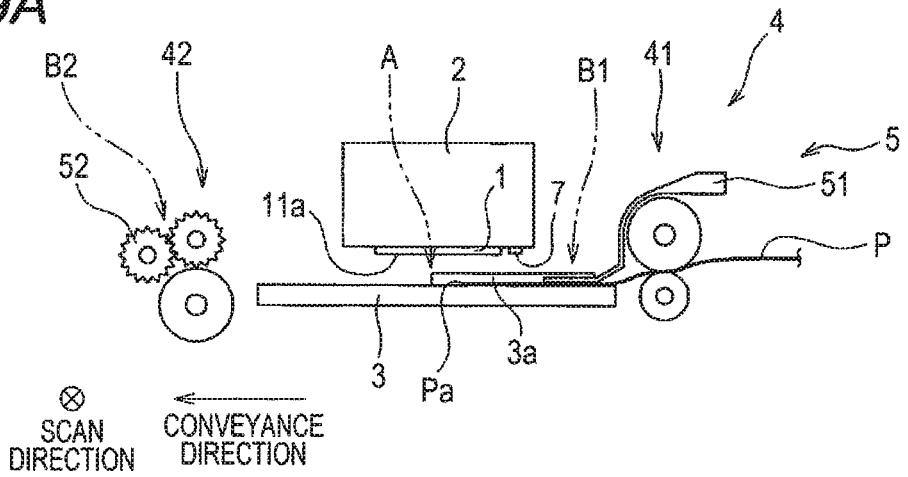
FIG. 9A is a view showing a state where a sheet is located at an upstream conveyance position.
Figure 9B:
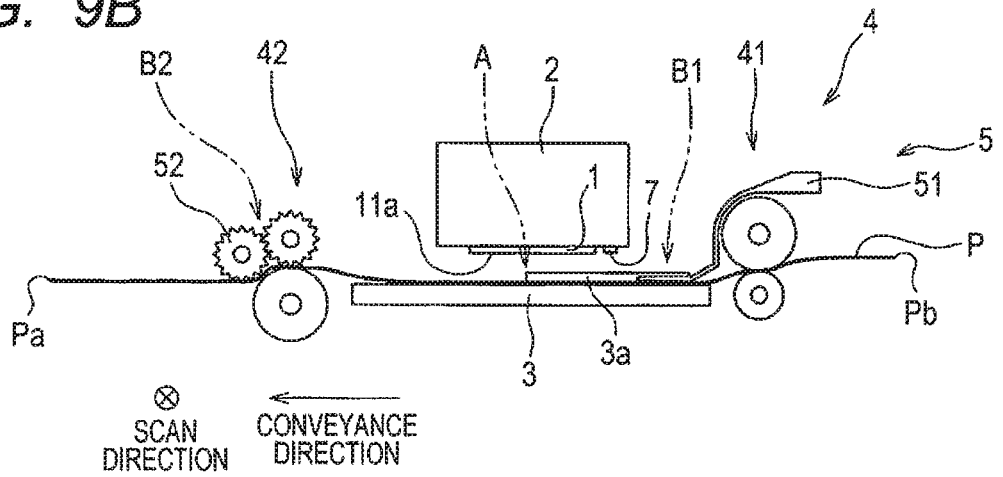
FIG. 9B is a view showing a state where a sheet is located at an intermediate conveyance position.
Figure 9C:
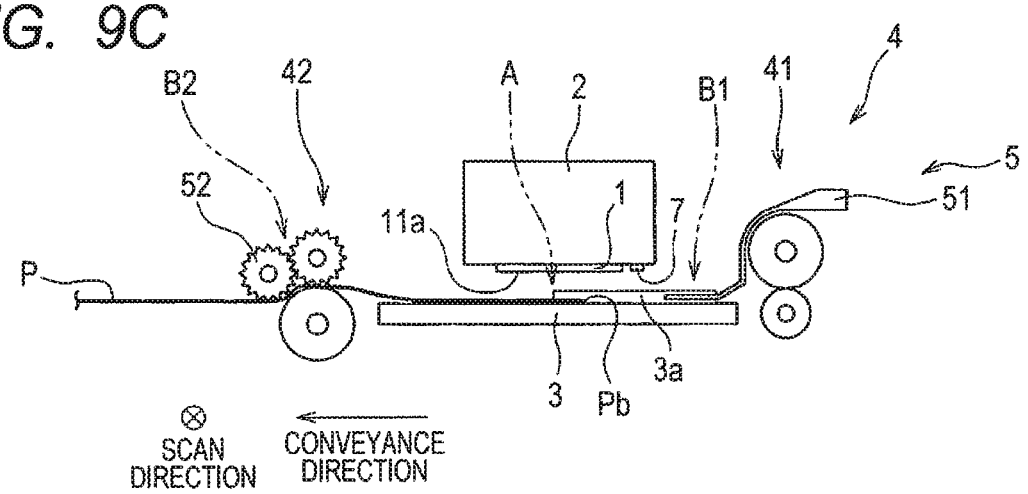
FIG. 9C is a view showing a state where a sheet is located at a downstream conveyance position.

Here, the position of the paper P in the conveyance path R includes an upstream conveyance position (refer to FIG. 9A) at which the leading edge Pa of the paper P is located between the upstream roller pair 41 and the downstream roller pairs 42, and the trailing edge Pb of the paper P is located at an upstream side of the upstream roller pair 41 in the conveyance direction, an intermediate conveyance position (refer to FIG. 9B) at which the leading edge Pa is located at a downstream side of the downstream roller pairs 42 in the conveyance direction, and the trailing edge Pb is located at an upstream side of the upstream roller pair 41 in the conveyance direction, and a downstream conveyance position (refer to FIG. 9C) at which the leading edge Pa is located at a downstream side of the downstream roller pairs 42 in the conveyance direction, and the trailing edge Pb is located between the upstream roller pair 41 and the downstream roller pairs 42. The CPU 91 changes the threshold as a condition for determination of recording interruption according to the above-described three positions (refer to FIG. 7). In detail, when the paper P is located at the upstream conveyance position, the CPU 91 makes a determination by using the threshold Y2 (upstream conveyance determination condition). When the paper P is located at the intermediate conveyance position, the CPU 91 makes a determination by using the threshold Y3 (intermediate conveyance determination condition). When the paper P is located at the downstream conveyance position, the CPU 91 makes a determination by using the threshold Y1 (downstream conveyance determination condition). As shown in FIG. 6, the thresholds Y1 to Y3 are values each corresponding to a distance between the surface of the paper P and the nozzle surface 11*a*, and the distance becomes longer in the order of the thresholds Y1 to Y3. That is, the paper-nozzle distance corresponding to the threshold Y2 is longer than the paper-nozzle distance corresponding to the threshold Y1, and the paper-nozzle distance corresponding to the threshold Y3 is longer than the paper-nozzle distance corresponding to the threshold Y2.

Figure 7:
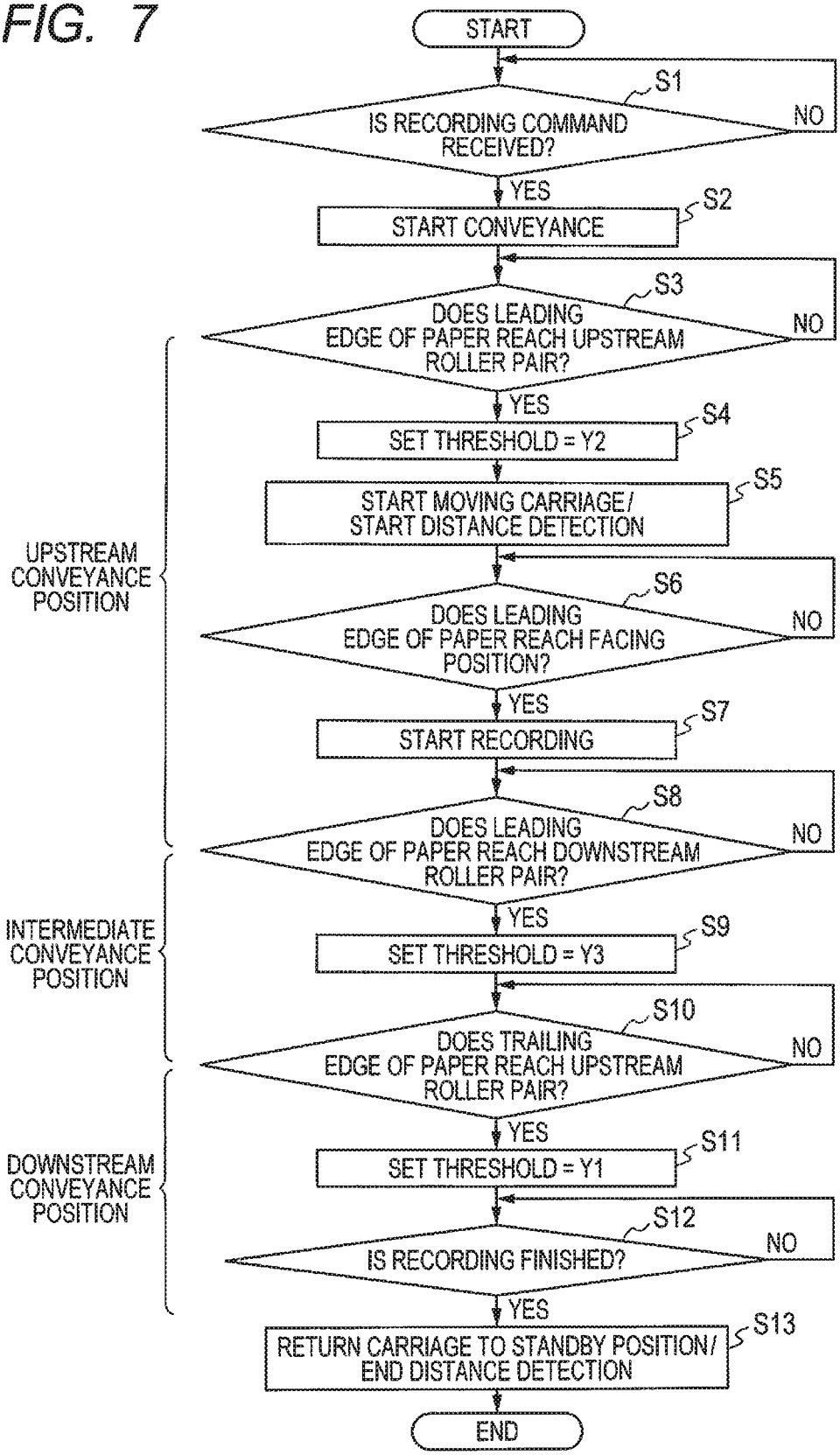
FIG. 7 is a flowchart showing control details relating to recording in the first embodiment of this disclosure.

As described above, according to the present embodiment, the condition for determination of recording interruption (in the present embodiment, threshold) is changed depending on a position of the paper P in the conveyance path R (refer to FIG. 7). In this way, by performing appropriate processing depending on a position of the paper P in the conveyance path R, throughput degradation is suppressed.

When the paper P is located at the upstream conveyance position (refer to FIG. 9A) or the downstream conveyance position (refer to FIG. 9C), the paper P is supported by either one of the upstream roller pair 41 and the downstream roller pairs 42 (so-called cantilever-support), and the leading edge Pa or the trailing edge Pb may float and come into contact with the nozzle surface 11*a*. However, in this case, by reasons that a force of contact of the paper P with the nozzle surface 11*a* is not so significant due to the cantilever support, and this is when recording on the paper P starts or ends, the necessity to prevent the contact of the paper P with the nozzle surface 11*a* is comparatively low. On the other hand, when the paper P is located at the intermediate conveyance position (refer to FIG. 9B), the paper P is supported at both ends by the upstream roller pair 41 and the downstream roller pairs 42, and for example, when the leading edge Pa reaches the downstream roller pairs 42 and jamming occurs, or when swelling occurs at an ink landing portion on the paper P, a portion of the paper P between the upstream roller pair 41 and the downstream roller pairs 42 may float and come into contact with the nozzle surface 11*a*. In this case, by reasons that a force of contact of the paper P with the nozzle surface 11*a* is significant due to supporting at both ends, and this is during recording on the paper P, and so on, the necessity to prevent the contact of the paper P with the nozzle surface 11*a* is comparatively high. In particular, when foreign matter such as sand enters from the outside and attaches to the paper P and the nozzle surface 11*a*, if the surface of the paper P comes into contact with the nozzle surface 11*a*, the nozzles 11*n* are significantly damaged due to friction between the foreign matter and the nozzle surface 11*a*, and therefore, the necessity to prevent contact of the paper P with the nozzle surface 11 is high. In this regard, in the present embodiment, the paper-nozzle distance corresponding to the value (threshold Y3) of the intermediate conveyance determination condition is longer than the paper-nozzle distance corresponding to the value (threshold Y2) of the upstream conveyance determination condition and the paper-nozzle distance corresponding to the value (threshold Y1) of the downstream conveyance determination condition (refer to FIG. 6). Accordingly, when the paper P is located at the intermediate conveyance position, the paper P is more securely prevented from coming into contact with the nozzle surface 11*a*.

When the paper P is located at the downstream conveyance position (refer to FIG. 9C), by reasons that this is when recording ends, and so on, the necessity to prevent contact of the paper P with the nozzle surface 11*a* is comparatively low. In other words, when the paper P is located at the upstream conveyance position (refer to FIG. 9A), the necessity to prevent contact of the paper P with the nozzle surface 11*a* is higher than when the paper P is located at the downstream conveyance position (refer to FIG. 9C). In this regard, in the embodiment, the paper-nozzle distance corresponding to a value of the upstream conveyance determination condition (threshold Y2) is longer than the paper-nozzle distance corresponding to a value of the downstream conveyance determination condition (threshold Y1) (refer to FIG. 6). Accordingly, when the paper P is located at the upstream conveyance position, the paper P is more securely prevented from coming into contact with the nozzle surface 11*a*.

The interval C1 between the upstream roller pair 41 and the optical sensor 7 in the conveyance direction is smaller than the interval C2 between the downstream roller pairs 42 and the optical sensor 7 in the conveyance direction (refer to FIG. 3). The nozzle surface 11*a* has nozzles 11*n* disposed at a downstream side of the optical sensor 7 in the conveyance direction. In this configuration, when the paper P is located at the upstream conveyance position (refer to FIG. 9A), the leading edge Pa of the paper P may come into contact with the nozzles 11*n* disposed at a downstream side of the optical sensor 7 in the conveyance direction. In this regard, in the present embodiment, the paper-nozzle distance corresponding to the value (threshold Y2) of the upstream conveyance determination condition is longer than the paper-nozzle distance corresponding to the value (threshold Y1) of the downstream conveyance determination condition (refer to FIG. 6). In this way, by setting the value of the upstream conveyance determination condition to a value at which the paper-nozzle distance is long, the paper P is prevented from coming into contact with the nozzles 11*n* disposed at a downstream side of the optical sensor 7 in the conveyance direction.

When interrupting image recording, the CPU 91 controls the conveyer 4 to stop conveyance of the paper P (refer to S19 in FIG. 8). When the paper P is conveyed in a state where the paper P is in contact with the nozzle surface 11*a*, the nozzle surface 11*a* is scratched and the nozzles 11*n* are significantly damaged. In this regard, the above-described configuration suppresses this problem.

When interrupting image recording, the CPU 91 causes an ejection operation to be stopped (refer to S19 in FIG. 8). If an ejection operation is performed in a state where the paper P is in contact with the nozzle surface 11*a*, the nozzle surface 11*a* is scratched and the nozzles 11*n* are significantly damaged. In this regard, the above-described configuration suppresses this problem.

The CPU 91 controls the notification device 8 to output a notification when interrupting image recording (refer to S19 in FIG. 8). Accordingly, a notification is given to a user to urge the user to perform an appropriate processing.

Second Embodiment

Next, a second embodiment of this disclosure will be described with reference to FIGS. 10 and 11. The printer of the second embodiment has the same configuration as the printer 100 of the first embodiment except that a position of the optical sensor 7 and setting of thresholds are different from those of the printer 100 of the first embodiment.

Figure 10:
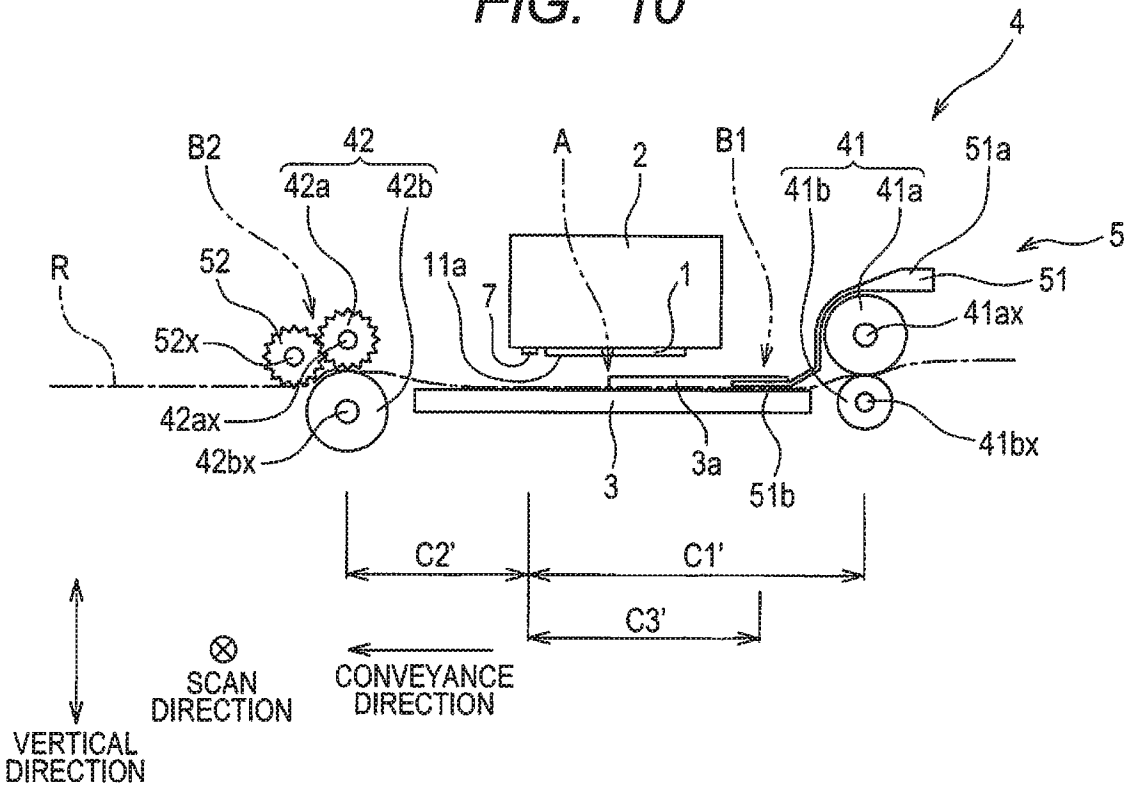
FIG. 10 is a side view of a printer according to a second embodiment of this disclosure, corresponding to FIG. 3.

In the first embodiment, the optical sensor 7 is disposed at an upstream side of the head 1 in the conveyance direction, however, in the present embodiment, the optical sensor 7 is disposed at a downstream side of the head 1 in the conveyance direction (refer to FIG. 10). In the present embodiment, an interval C1' between the upstream roller pair 41 and the optical sensor 7 in the conveyance direction and an interval C3' between a pressing position B1 and the optical sensor 7 in the conveyance direction are larger than an interval C2' between the downstream roller pairs 42 and the optical sensor 7 in the conveyance direction (C1'>C3'>C2'). All nozzles formed on the nozzle surface 11*a* are disposed at an upstream side of the optical sensor 7 in the conveyance direction.

Figure 11:
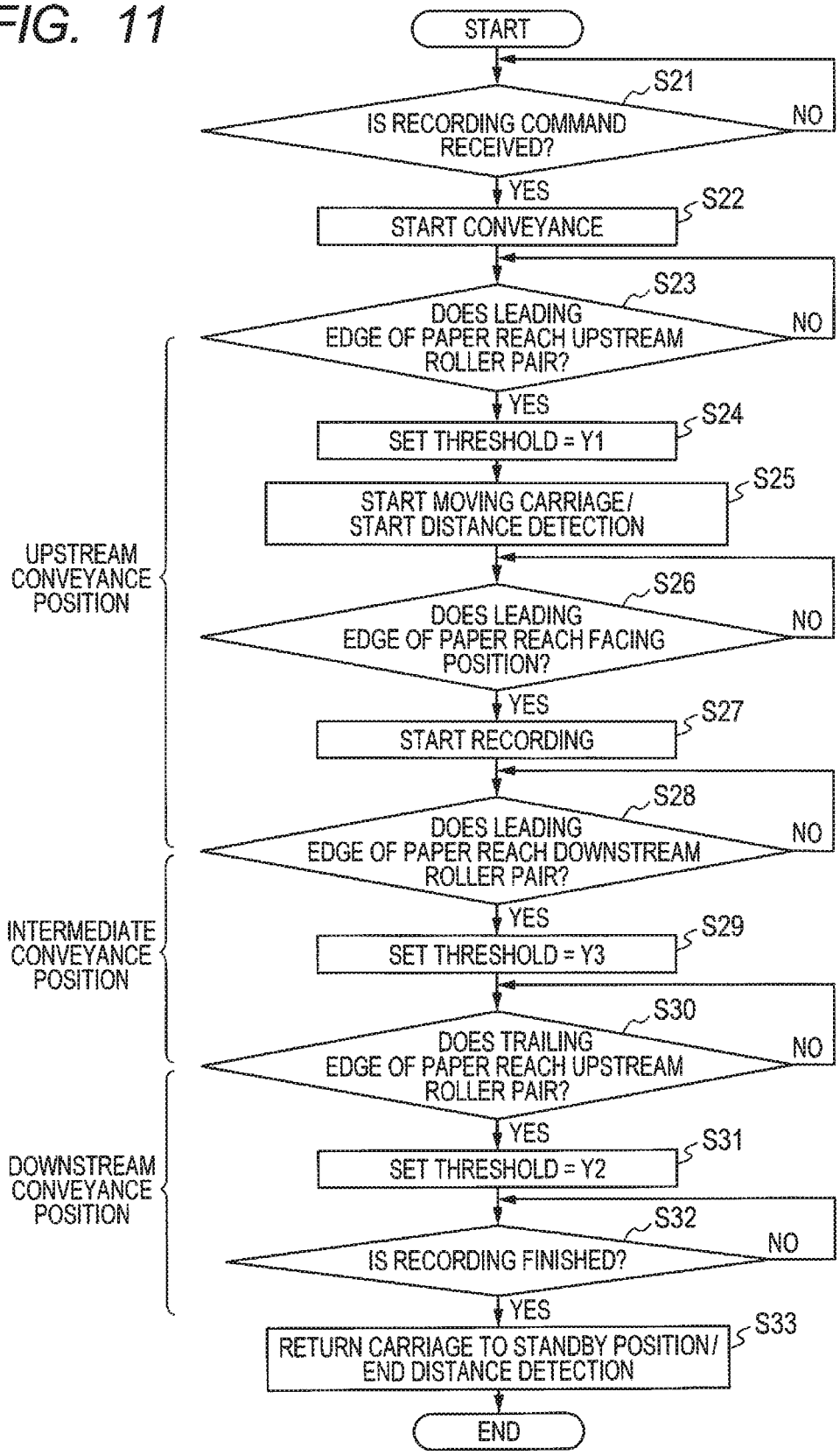
FIG. 11 is a flowchart showing control details relating to recording in a second embodiment of this disclosure.

In this disposition of the optical sensor 7, in the present embodiment, the CPU 91 performs control relating to recording shown in FIG. 11. First, the CPU 91 performs the processing of S21 to S23 same as S1 to S3. Then, when the leading edge of the paper P reaches the upstream roller pair 41 (S23: YES), the CPU 91 sets the threshold to Y1 (S24). After S24, the CPU 91 performs the processing of S25 to S30 same as S5 to S10. Then, when the trailing edge of the paper P reaches the upstream roller pair 41 (S30: YES), the CPU 91 sets the threshold to Y2 (S31). After S31, the CPU 91 performs the processing of S32 and S33 same as S12 and S13, and ends this routine.

That is, in the first embodiment, the value of the upstream conveyance determination condition is set to the threshold Y2, and the value of the downstream conveyance determination condition is set to the threshold Y1, however, in the present embodiment, the value of the upstream conveyance determination condition is set to the threshold Y1, and the value of the downstream conveyance determination condition is set to the threshold Y2.

As described above, according to the present embodiment, the following effects are obtained, in addition to the same effects due to the same configuration as the first embodiment.

The interval C1' between the upstream roller pair 41 and the optical sensor 7 in the conveyance direction is larger than the interval C2' between the downstream roller pair 42 and the optical sensor 7 in the conveyance direction (refer to FIG. 10). The nozzle surface 11*a* has nozzles 11*n* disposed at an upstream side of the optical sensor 7 in the conveyance direction. In this configuration, when the paper P is located at the downstream conveyance position (refer to FIG. 9C), the trailing edge Pb of the paper P may come into contact with the nozzles 11*n* disposed at an upstream side of the optical sensor 7 in the conveyance direction. In this regard, in the present embodiment, the paper-nozzle distance corresponding to the value (threshold Y2) of the downstream conveyance determination condition is longer than the paper-nozzle distance corresponding to the value (threshold Y1) of the upstream conveyance determination condition (refer to FIG. 6). In this way, by setting the value of the downstream conveyance determination condition to a value at which the paper-nozzle distance is long, the paper P is prevented from coming into contact with the nozzles 11*n* disposed at an upstream side of the optical sensor 7 in the conveyance direction.

Third Embodiment

Figure 12:
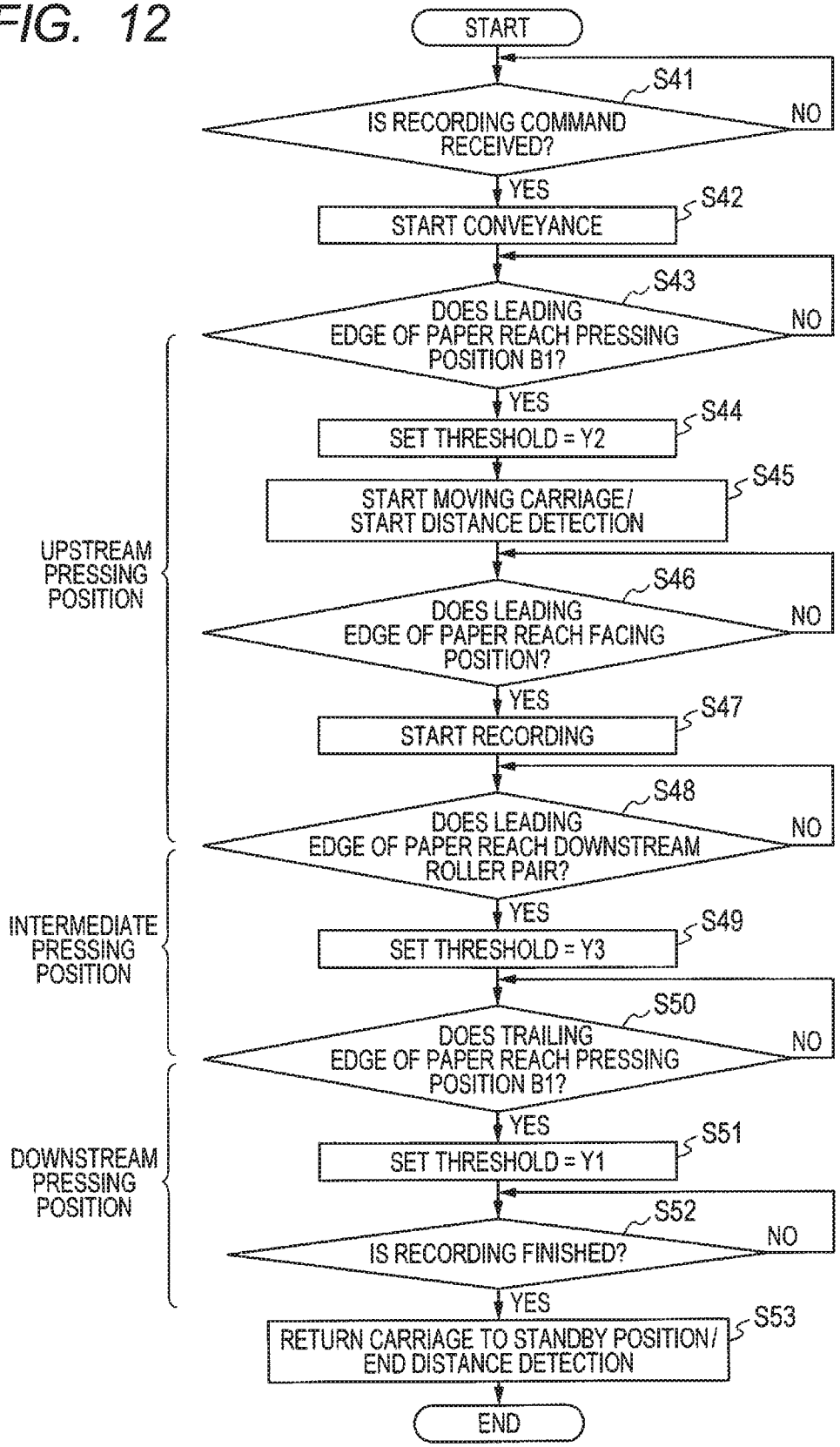
FIG. 12 is a flowchart showing control details relating to recording in a third embodiment of this disclosure.

Next, a third embodiment of this disclosure will be described with reference to FIG. 12. The printer of the third embodiment has the same configuration as the printer 100 of the first embodiment except that a position used as a reference for changing thresholds is different from that of the printer 100 of the first embodiment.

In the first embodiment, the threshold is changed according to positional relationships of the upstream roller pair 41 and the downstream roller pairs 42 with the leading edge and the trailing edge of the paper P. On the other hand, in the present embodiment, the threshold is changed according to positional relationships of the pressing position B1 and the downstream roller pairs 42 with the leading edge and the trailing edge of the paper P.

In detail, first, the CPU 91 performs the processing of S41 and S42 same as S1 and S2. After S42, the CPU 91 determines whether the leading edge of the paper P has reached the pressing position B1 based on a signal of the rotary encoder 46 transferred from the ASIC 94 (S43). When the leading edge of the paper P does not reach the pressing position B1 (S43: NO), the processing of S43 is repeated. When the leading edge of the paper P reaches the pressing position B1 (S43: YES), the CPU 91 performs the processing of S44 to S49 same as S4 to S9. After S49, the CPU 91 determines whether the trailing edge of the paper P has reached the pressing position B1 based on a signal of the rotary encoder 46 transferred from the ASIC 94 (S50). When the trailing edge of the paper P does not reach the pressing position B1 (S50: NO), the processing of S50 is repeated. When the trailing edge of the paper P reaches the pressing position B1 (S50: YES), the CPU 91 performs the processing of SM to S53 same as S11 to S13, and ends this routine.

In the present embodiment, the position of the paper P in the conveyance path R includes an upstream pressing position (refer to FIG. 9A) at which the leading edge Pa of the paper P is located between the pressing position B1 and the downstream roller pairs 42, and the trailing edge Pb of the paper P is located at an upstream side of the pressing position B1 in the conveyance direction, an intermediate pressing position (refer to FIG. 9B) at which the leading edge Pa is located at a downstream side of the downstream roller pairs 42 in the conveyance direction, and the trailing edge Pb is located at an upstream side of the pressing position B1 in the conveyance direction, and a downstream pressing position (refer to FIG. 9C) at which the leading edge Pa is located at a downstream side of the downstream roller pairs 42 in the conveyance direction, and the trailing edge Pb is located between the pressing position B1 and the downstream roller pairs 42. The CPU 91 changes the threshold as a condition for determination of recording interruption depending on the above-described three positions (refer to FIG. 12). In detail, when the paper P is located at the upstream pressing position, the CPU 91 makes a determination by using the threshold Y2 (upstream pressing determination condition). When the paper P is located at the intermediate pressing position, the CPU 91 makes a determination by using the threshold Y3 (intermediate pressing determination condition). When the paper P is located at the downstream pressing position, the CPU 91 makes a determination by using the threshold Y1 (downstream pressing determination condition).

As described above, according to the present embodiment, the following effects are obtained, in addition to the same effects due to the same configuration as the first embodiment.

When the paper P is located at the upstream pressing position (refer to FIG. 9A), the paper P receives pressing from the corrugation plates 51 but is not supported by the downstream roller pair 42. When the paper P is located at the downstream pressing position (refer to FIG. 9C), the paper P does not receive pressing from the corrugation plates 51 and is supported by the downstream roller pairs 42 (cantilever-support). In these cases, the leading edge Pa or the trailing edge Pb may float and come into contact with the nozzle surface 11*a*. However, by reasons that a force of contact of the paper P with the nozzle surface 11*a* is not so significant due to the cantilever support, and this is when recording on the paper P starts or ends, the necessity to prevent the contact of the paper P with the nozzle surface 11*a* is comparatively low. On the other hand, when the paper P is located at the intermediate pressing position (refer to FIG. 9B), the paper P receives pressing from the corrugation plates 51 and is supported by the downstream roller pairs 42, and for example, when the leading edge Pa reaches the downstream roller pairs 42 and jamming occurs, or when swelling occurs at an ink landing portion on the paper P, a portion of the paper P between the corrugation plates 51 and the downstream roller pairs 42 may float and come into contact with the nozzle surface 11*a*. In this case, by reasons that a force of contact of the paper P with the nozzle surface 11*a* is significant due to being supported by both the corrugation plates 51 and the downstream roller pairs 42, and this is during recording on the paper P, and so on, the necessity to prevent the contact of the paper P with the nozzle surface 11*a* is comparatively high. In particular, when foreign matter such as sand enters from the outside and attaches to the paper P and the nozzle surface 11*a*, if the surface of the paper P comes into contact with the nozzle surface 11*a*, the nozzles 11*n* are significantly damaged due to friction between the foreign matter and the nozzle surface 11*a*, and therefore, the necessity to prevent contact of the paper P with the nozzle surface 11 is high. In this regard, in the present embodiment, the paper-nozzle distance corresponding to the value (threshold Y3) of the intermediate pressing determination condition is longer than the paper-nozzle distance corresponding to the value (threshold Y2) of the upstream pressing determination condition and the paper-nozzle distance corresponding to the value (threshold Y1) of the downstream pressing determination condition (refer to FIG. 6). Accordingly, when the paper P is located at the intermediate pressing position, the paper P is more securely prevented from coming into contact with the nozzle surface 11*a*.

When the paper P is located at the downstream pressing position (refer to FIG. 9C), by reasons that this is when recording ends, and so on, the necessity to prevent contact of the paper P with the nozzle surface 11*a* is comparatively low. In other words, when the paper P is located at the upstream pressing position (refer to FIG. 9A), the necessity to prevent contact of the paper P with the nozzle surface 11*a* is higher than when the paper P is located at the downstream pressing position (refer to FIG. 9C). In this regard, in the embodiment, the paper-nozzle distance corresponding to a value of the upstream pressing determination condition (threshold Y2) is longer than the paper-nozzle distance corresponding to a value of the downstream pressing determination condition (threshold Y1) (refer to FIG. 6). Accordingly, when the paper P is located at the upstream pressing position, the paper P is more securely prevented from coming into contact with the nozzle surface 11*a*.

The interval C3 between the pressing position B1 and the optical sensor 7 in the conveyance direction is smaller than the interval C2 between the downstream roller pairs 42 and the optical sensor 7 in the conveyance direction (refer to FIG. 3). The nozzle surface 11*a* has nozzles 11*n* disposed at a downstream side of the optical sensor 7 in the conveyance direction. In this configuration, when the paper P is located at the upstream pressing position (refer to FIG. 9A), the leading edge Pa of the paper P may come into contact with the nozzles 11*n* disposed at a downstream side of the optical sensor 7 in the conveyance direction. In this regard, in the present embodiment, the paper-nozzle distance corresponding to the value (threshold Y2) of the upstream pressing determination condition is longer than the paper-nozzle distance corresponding to the value (threshold Y1) of the downstream pressing determination condition (refer to FIG. 6). In this way, by setting the value of the upstream pressing determination condition to a value at which the paper-nozzle distance is long, the paper P is prevented from coming into contact with the nozzles 11*n* disposed at a downstream side of the optical sensor 7 in the conveyance direction.

Fourth Embodiment

Next, a fourth embodiment of this disclosure will be described with reference to FIG. 13. The printer of the fourth embodiment has the same configuration as the printer of the third embodiment except that a position of the optical sensor 7 and setting of thresholds are different from that of the printer of the third embodiment.

In the third embodiment, the optical sensor 7 is disposed at an upstream side of the head 1 in the conveyance direction as in the first embodiment, however, in the present embodiment, the optical sensor 7 is disposed at a downstream side of the head 1 in the conveyance direction as in the second embodiment (refer to FIG. 10).

Figure 13:
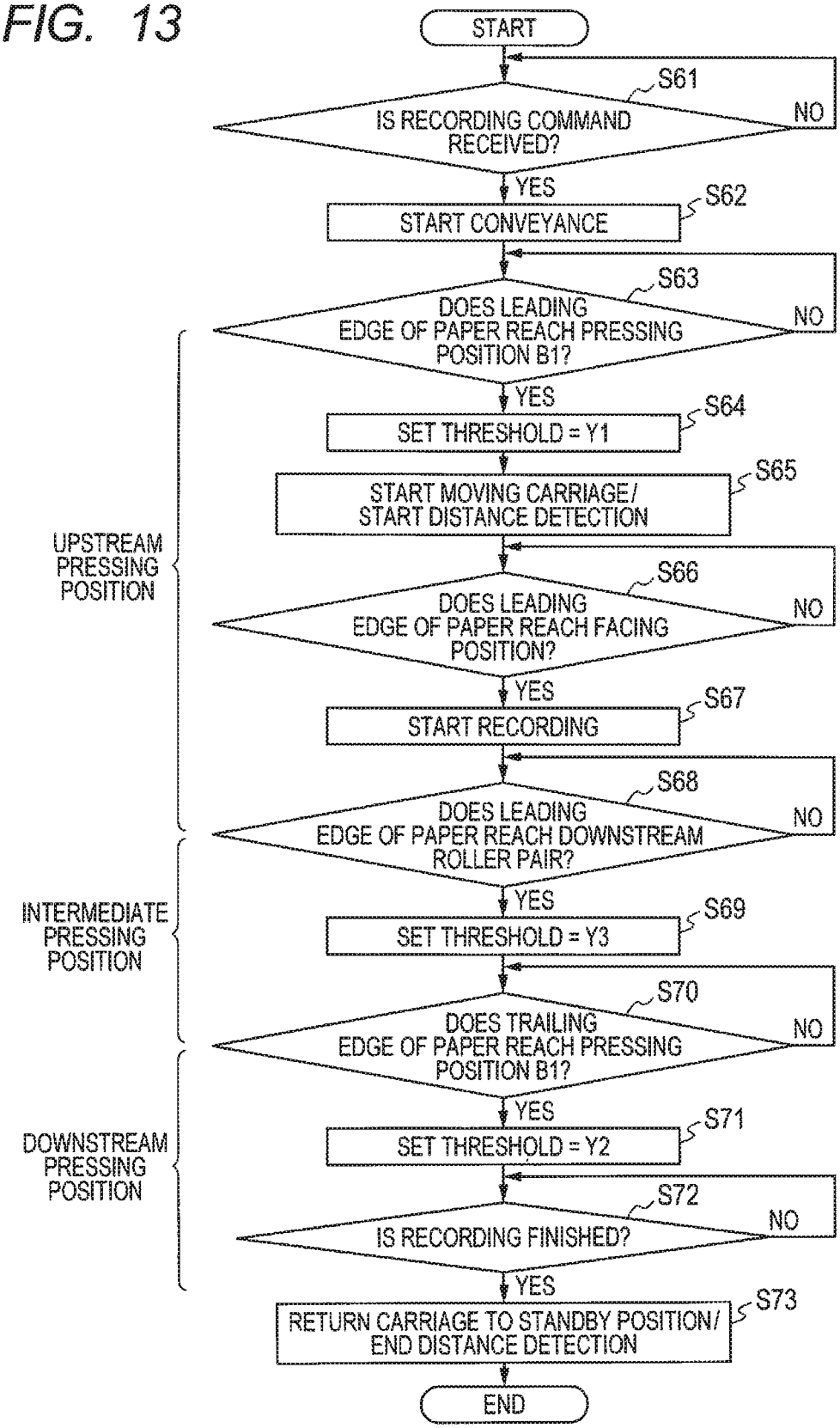
FIG. 13 is a flowchart showing control details relating to recording in a fourth embodiment of this disclosure.

In this disposition of the optical sensor 7, in the present embodiment, the CPU 91 performs control relating to recording shown in FIG. 13. First, the CPU 91 performs the processing of S61 to S63 same as S41 to S43. Then, when the leading edge of the paper P reaches the pressing position B1 (S63: YES), the CPU 91 sets the threshold to Y1 (S64). After S64, the CPU 91 performs the processing of S65 to S70 same as S45 to S50. Then, when the trailing edge of the paper P reaches the pressing position B1 (S70: YES), the CPU 91 sets the threshold to Y2 (S71). After S71, the CPU 91 performs the processing of S72 and S73 same as S52 and S53, and ends this routine.

That is, in the third embodiment, the value of the upstream pressing determination condition is set to the threshold Y2, and the value of the downstream pressing determination condition is set to the threshold Y1, however, in the present embodiment, the value of the upstream pressing determination condition is set to the threshold Y1, and the value of the downstream pressing determination condition is set to the threshold Y2.

As described above, according to the present embodiment, the following effects are obtained, in addition to the same effects due to the same configuration as the third embodiment.

The interval C1' between the upstream roller pair 41 and the optical sensor 7 in the conveyance direction is larger than the interval C2' between the downstream roller pair 42 and the optical sensor 7 in the conveyance direction (refer to FIG. 10). The nozzle surface 11*a* has nozzles 11*n* disposed at an upstream side of the optical sensor 7 in the conveyance direction. In this configuration, when the paper P is located at the downstream pressing position (refer to FIG. 9C), the trailing edge Pb of the paper P may come into contact with the nozzles 11*n* disposed at an upstream side of the optical sensor 7 in the conveyance direction. In this regard, in the present embodiment, the paper-nozzle distance corresponding to the value (threshold Y2) of the downstream pressing determination condition is longer than the paper-nozzle distance corresponding to the value (threshold Y1) of the upstream pressing determination condition (refer to FIG. 6). In this way, by setting the value of the downstream pressing determination condition to a value at which the paper-nozzle distance is long, the paper P is prevented from coming into contact with the nozzles 11*n* disposed at an upstream side of the optical sensor 7 in the conveyance direction.

Fifth Embodiment

Figure 14:
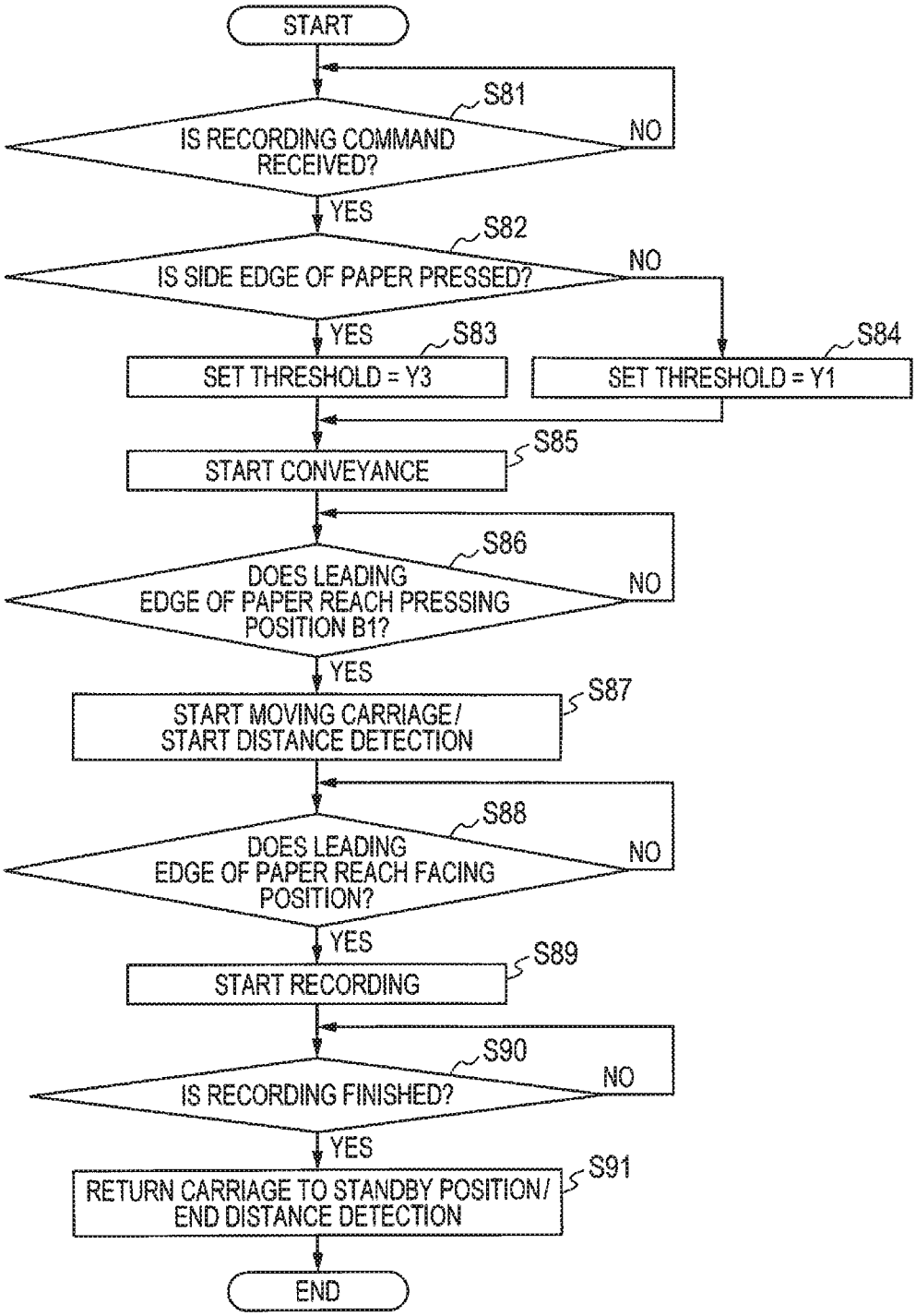
FIG. 14 is a flowchart showing control details relating to recording in a fifth embodiment of this disclosure.

Next, a fifth embodiment of this disclosure will be described with reference to FIG. 14. The printer of the fifth embodiment has the same configuration as the printer 100 of the first embodiment except that determination condition of threshold change is different from that of the printer 100 of the first embodiment.

In the first embodiment, the threshold is changed according to positional relationships of the upstream roller pair 41 and the downstream roller pairs 42 with the leading edge and the trailing edge of the paper P. On the other hand, in the present embodiment, the threshold is changed depending on whether a side edge (end portion in the scan direction) of the paper P is pressed by the corrugation plates 51 when recording an image on the paper P.

In detail, first, the CPU 91 performs the processing of S81 same as S1. Then, when the CPU 91 receives a recording command (S81: YES), based on information on a size of the paper P included in the recording command, the CPU 91 determines whether the side edge of the paper P is pressed by the corrugation plates 51 at the time of image recording on the paper P (S82). That is, information included in the recording command is an example of "positional information."

When the side edge of the paper P is pressed by the corrugation plates 51 at the time of image recording on the paper P (S82: YES), the CPU 91 sets the threshold to Y3 (S83). When the side edge of the paper P is not pressed by the corrugation plates 51 at the time of image recording on the paper P (S82: NO), the CPU 91 sets the threshold to Y1 (S84). After S83 or S84, the CPU 91 performs the processing of S85 same as S2.

After S85, based on a signal of the rotary encoder 46 transferred from the ASIC 94, the CPU 91 determines whether the leading edge of the paper P has reached the pressing position B1 (S86). When the leading edge of the paper P does not reach the pressing position B1 (S86: NO), the processing of S86 is repeated. When the leading edge of the paper P reaches the pressing position B1 (S86: YES), the CPU 91 performs the processing of S87 to S89 same as S5 to S7. After S89, the CPU 91 performs the processing of S90 and S91 same as S12 and S13, and ends this routine.

That is, in the present embodiment, when the side edge of the paper P is pressed by the corrugation plates 51 at the time of image recording on the paper P, the CPU 91 makes a determination by using the threshold Y3 (edge pressing determination condition), and when the side edge of the paper P is not pressed by the corrugation plates 51 at the time of image recording on the paper P, the CPU 91 makes a determination by using the threshold Y1 (edge no-pressing determination condition). The paper-nozzle distance corresponding to the value (threshold Y3) of the edge pressing determination condition is longer than the paper-nozzle distance corresponding to the value (threshold Y1) of the edge no-pressing determination condition.

As described above, according to the present embodiment, the following effects are obtained, in addition to the same effects due to the same configuration as the first embodiment.

When the side edge of the paper P is not pressed by the corrugation plates 51, the vicinity of the side edge of the paper P does not receive pressing, so that it may float and approach the nozzle surface 11*a*. In this case, if the paper-nozzle distance is determined to be small and image recording is interrupted, the throughput is degraded. In this regard, in the present embodiment, the paper-nozzle distance corresponding to the threshold Y1 (edge no-pressing determination condition) when the side edge of the paper P is not pressed by the corrugation plates 51 is shorter than the paper-nozzle distance corresponding to the threshold Y3

(edge pressing determination condition) when the side edge of the paper P is pressed by the corrugation plates 51 (refer to FIG. 6). Therefore, when the side edge of the paper P is not pressed by the corrugation plates 51, the image recording is not likely to be interrupted because the paper-nozzle distance is small, so that the throughput degradation is suppressed.

Sixth Embodiment

Next, a sixth embodiment of this disclosure will be described with reference to FIG. 15. The printer of the sixth embodiment has the same configuration as the printer 100 of the first embodiment except that control details depending on a position of the paper P in the conveyance path R are different from that of the printer 100 of the first embodiment.

In the first embodiment, depending on a position of the paper P in the conveyance path R, the recording interruption determination condition (threshold) is changed, however, in the present embodiment, depending on a position of the paper P in the conveyance path R, a determination as to whether to perform distance detection is changed.

Figure 15:
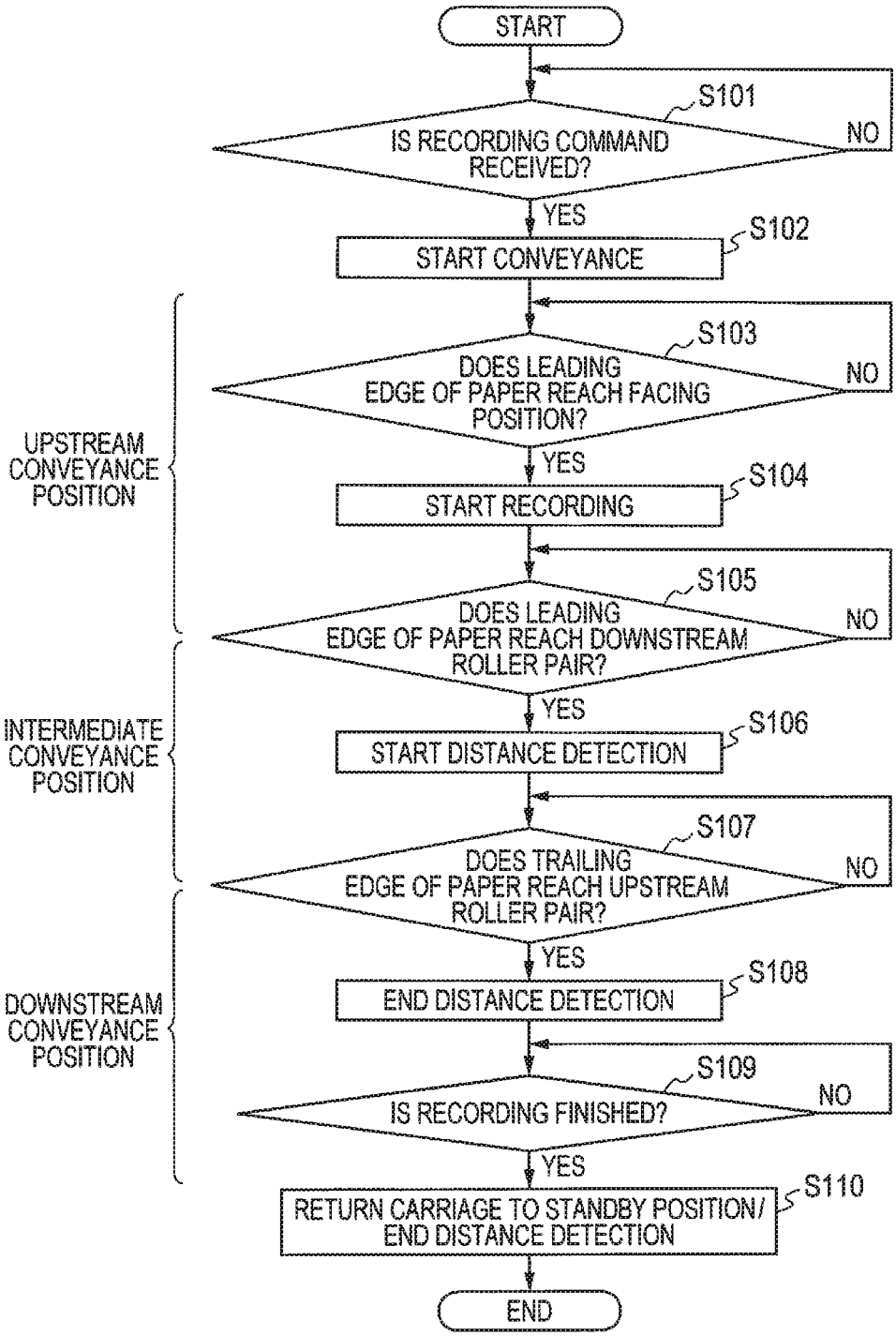
FIG. 15 is a flowchart showing control details relating to recording in a sixth embodiment of this disclosure.

In the present embodiment, the CPU 91 performs control relating to recording shown in FIG. 15. First, the CPU 91 performs the processing of S101 and S102 same as S1 and S2. After S102, based on a signal of the rotary encoder 46 transferred from the ASIC 94, the CPU 91 determines whether the leading edge of the paper P has reached the facing position A (S103). When the leading edge of the paper P does not reach the facing position A (S103: NO), the processing of S103 is repeated. When the leading edge of the paper P reaches the facing position A (S103: YES), the CPU 91 performs the processing of S104 and S105 same as S7 and S8. Then, when the leading edge of the paper P reaches the downstream roller pairs 42 (S105: YES), the CPU 91 starts distance detection (S106). When starting distance detection, the CPU 91 inputs an input signal with a PWM value set to the input setting value X into the light emission element 7*a* through the ASIC 94 to make the light emission element 7*a* start light emission. Then, the CPU 91 performs distance detection based on an output signal from the light reception element 7*b*. During distance detection, the CPU 91 performs the above-described recording interruption determination processing (refer to FIG. 8).

After S106, the CPU 91 performs the processing of S107 same as S10. Then, when the trailing edge of the paper P reaches the upstream roller pair 41 (S107: YES), the CPU 91 ends the distance detection (S108). When ending the distance detection, the CPU 91 stops input of the input signal into the light emission element 7*a*. The CPU 91 also ends the recording interruption determination processing (refer to FIG. 8) along with ending of the distance detection. After S108, the CPU 91 performs the processing of S109 and S110 same as S12 and S13, and ends this routine.

That is, when the paper P is located at the intermediate conveyance position (refer to FIG. 9B), the CPU 91 performs distance detection, and when the paper P is located at the upstream conveyance position (refer to FIG. 9A) or the downstream conveyance position (refer to FIG. 9C), the CPU 91 does not perform distance detection.

As described above, according to the present embodiment, the following effects are obtained, in addition to the same effects due to the same configuration as the first embodiment.

At the time of image recording on the paper P, when a position signal satisfies a particular condition (in the present embodiment, when a signal of the rotary encoder 46 shows that the paper P is located at the intermediate conveyance position), distance detection is performed, and when the position signal does not satisfy the particular condition, distance detection is not performed. In this way, by performing appropriate processing depending on a position of the paper P in the conveyance path R, throughput degradation is suppressed.

When the paper P is located at the upstream conveyance position (refer to FIG. 9A) or the downstream conveyance position (refer to FIG. 9C), the paper P is supported by either one of the upstream roller pair 41 and the downstream roller pairs 42 (so-called cantilever-support), and the leading edge Pa or the trailing edge Pb may float and come into contact with the nozzle surface 11*a*. However, in this case, by reasons that a force of contact of the paper P with the nozzle surface 11*a* is not so significant due to the cantilever support, and this is when recording on the paper P starts or ends, the necessity to prevent the contact of the paper P with the nozzle surface 11*a* is comparatively low. On the other hand, when the paper P is located at the intermediate conveyance position (refer to FIG. 9B), the paper P is supported at both ends by the upstream roller pair 41 and the downstream roller pairs 42, and for example, when the leading edge Pa reaches the downstream roller pairs 42 and jamming occurs, or when swelling occurs at an ink landing portion on the paper P, a portion of the paper P between the upstream roller pair 41 and the downstream roller pairs 42 may float and come into contact with the nozzle surface 11*a*. In this case, by reasons that a force of contact of the paper P with the nozzle surface 11*a* is significant due to supporting at both ends, and this is during recording on the paper P, and so on, the necessity to prevent the contact of the paper P with the nozzle surface 11*a* is comparatively high. In particular, when foreign matter such as sand enters from the outside and attaches to the paper P and the nozzle surface 11*a*, if the surface of the paper P comes into contact with the nozzle surface 11*a*, the nozzles 11*n* are significantly damaged due to friction between the foreign matter and the nozzle surface 11*a*, and therefore, the necessity to prevent contact of the paper P with the nozzle surface 11 is high. In this regard, in the present embodiment, distance detection is performed when the paper P is located at the intermediate conveyance position, whereas distance detection is not performed when the paper P is located at the upstream conveyance position or the downstream conveyance position. Accordingly, when the paper P is located at the intermediate conveyance position, the paper P is more securely prevented from coming into contact with the nozzle surface 11*a*. And, when the paper P is located at the upstream conveyance position or the downstream conveyance position, unnecessary processing is not performed and throughput degradation is suppressed.

Seventh Embodiment

Figure 16:
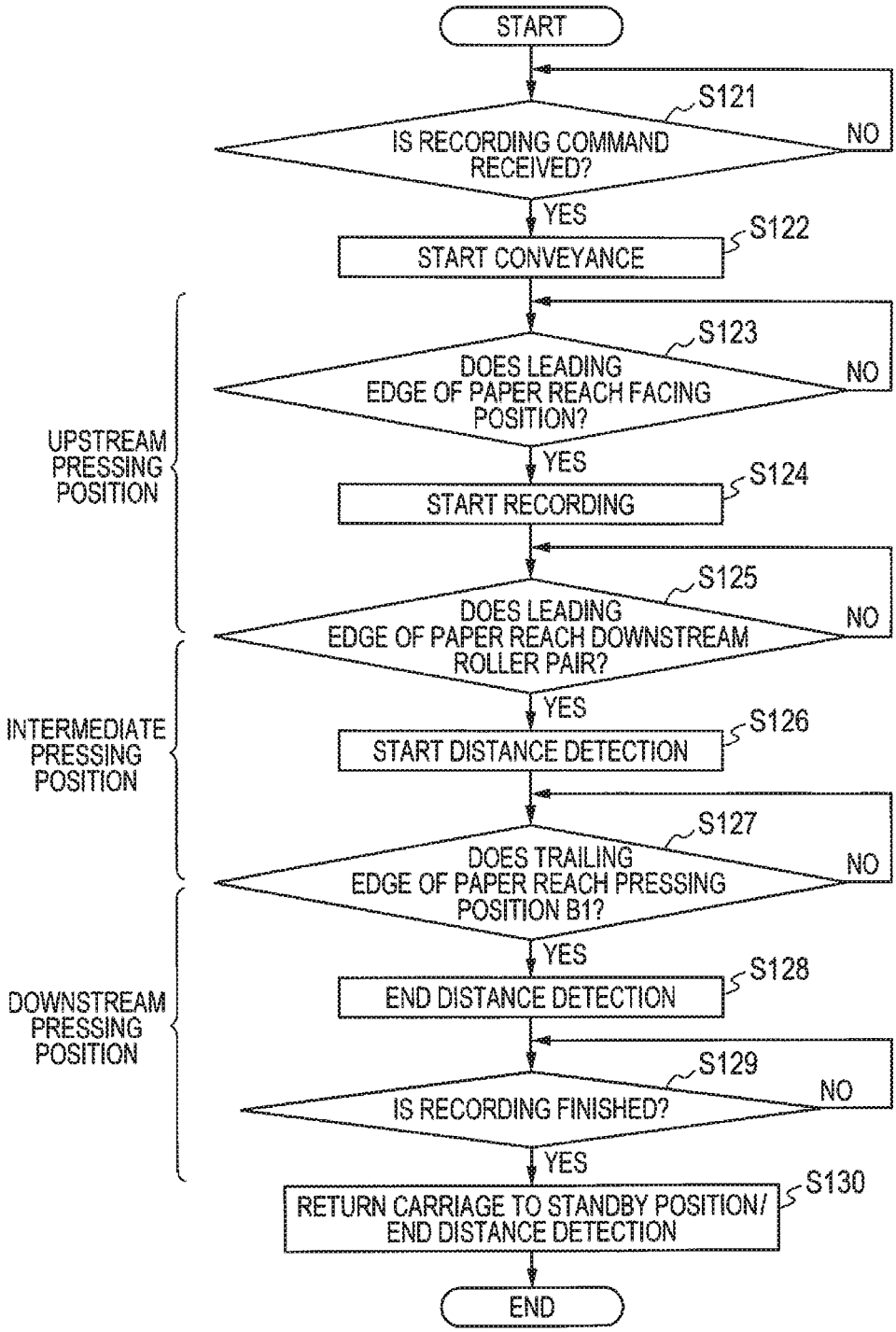
FIG. 16 is a flowchart showing control details relating to recording in a seventh embodiment of this disclosure.

Next, a seventh embodiment of this disclosure will be described with reference to FIG. 16. The printer of the seventh embodiment has the same configuration as the printer of the sixth embodiment except that a position used as a determination condition for determining whether to perform distance detection is different from that of the printer of the sixth embodiment.

In the sixth embodiment, whether to perform distance detection is determined depending on positional relationships of the upstream roller pair 41 and the downstream roller pairs 42 with the leading edge and the trailing edge of the paper P. On the other hand, in the present embodiment, whether to perform distance detection is determined depending on positional relationships of the pressing position B1 and the downstream roller pairs 42 with the leading edge and the trailing edge of the paper P.

In detail, first, the CPU 91 performs the processing of S121 to S126 same as S101 to S106. After S126, the CPU 91 determines whether the trailing edge of the paper P has reached the pressing position B1 based on a signal of the rotary encoder 46 transferred from the ASIC 94 (S127). When the trailing edge of the paper P does not reach the pressing position B1 (S127: NO), the processing of S127 is repeated. When the trailing edge of the paper P reaches the pressing position B1 (S127: YES), the CPU 91 performs the processing of S128 to S130 same as S108 to S110, and ends this routine.

In the present embodiment, a position of the paper P in the conveyance path R includes an upstream pressing position (refer to FIG. 9A) at which the leading edge Pa of the paper P is located between the pressing position B1 and the downstream roller pairs 42, and the trailing edge Pb of the paper P is located at an upstream side of the pressing position B1 in the conveyance direction, an intermediate pressing position (refer to FIG. 9B) at which the leading edge Pa is located at a downstream side of the downstream roller pairs 42 in the conveyance direction, and the trailing edge Pb is located at an upstream side of the pressing position B1 in the conveyance direction, and a downstream pressing position (refer to FIG. 9C) at which the leading edge Pa is located at a downstream side of the downstream roller pairs 42 in the conveyance direction, and the trailing edge Pb is located between the pressing position B1 and the downstream roller pairs 42. When the paper P is located at the intermediate pressing position, the CPU 91 performs distance detection, and when the paper P is located at the upstream pressing position or the downstream pressing position, the CPU 91 does not perform distance detection.

As described above, according to the present embodiment, the following effects are obtained, in addition to the same effects due to the same configuration as the first embodiment.

When the paper P is located at the upstream pressing position (refer to FIG. 9A), the paper P receives pressing from the corrugation plates 51 but is not supported by the downstream roller pair 42. When the paper P is located at the downstream pressing position (refer to FIG. 9C), the paper P does not receive pressing from the corrugation plates 51 and is supported by the downstream roller pairs 42 (cantilever-support). In these cases, the leading edge Pa or the trailing edge Pb may float and come into contact with the nozzle surface 11*a*. However, by reasons that a force of contact of the paper P with the nozzle surface 11*a* is not so significant due to the cantilever support, and this is when recording on the paper P starts or ends, the necessity to prevent the contact of the paper P with the nozzle surface 11*a* is comparatively low. On the other hand, when the paper P is located at the intermediate pressing position (refer to FIG. 9B), the paper P receives pressing from the corrugation plates 51 and is supported by the downstream roller pairs 42, and for example, when the leading edge Pa reaches the downstream roller pairs 42 and jamming occurs, or when swelling occurs at an ink landing portion on the paper P, a portion of the paper P between the corrugation plates 51 and the downstream roller pairs 42 may float and come into contact with the nozzle surface 11*a*. In this case, by reasons that a force of contact of the paper P with the nozzle surface 11*a* is significant due to being supported by both the corrugation plates 51 and the downstream roller pairs 42, and this is during recording on the paper P, and so on, the necessity to prevent the contact of the paper P with the nozzle surface 11*a* is comparatively high. In particular, when foreign matter such as sand enters from the outside and attaches to the paper P and the nozzle surface 11*a*, if the surface of the paper P comes into contact with the nozzle surface 11*a*, the nozzles 11*n* are significantly damaged due to friction between the foreign matter and the nozzle surface 11*a*, and therefore, the necessity to prevent contact of the paper P with the nozzle surface 11 is high. In this regard, in the present embodiment, distance detection is performed when the paper P is located at the intermediate pressing position, whereas distance detection is not performed when the paper P is located at the upstream pressing position or the downstream pressing position. Accordingly, when the paper P is located at the intermediate pressing position, the paper P is more securely prevented from coming into contact with the nozzle surface 11*a*. And, when the paper P is located at the upstream pressing position or the downstream pressing position, unnecessary processing is not performed and throughput degradation is suppressed.

Eighth Embodiment

Figure 17:
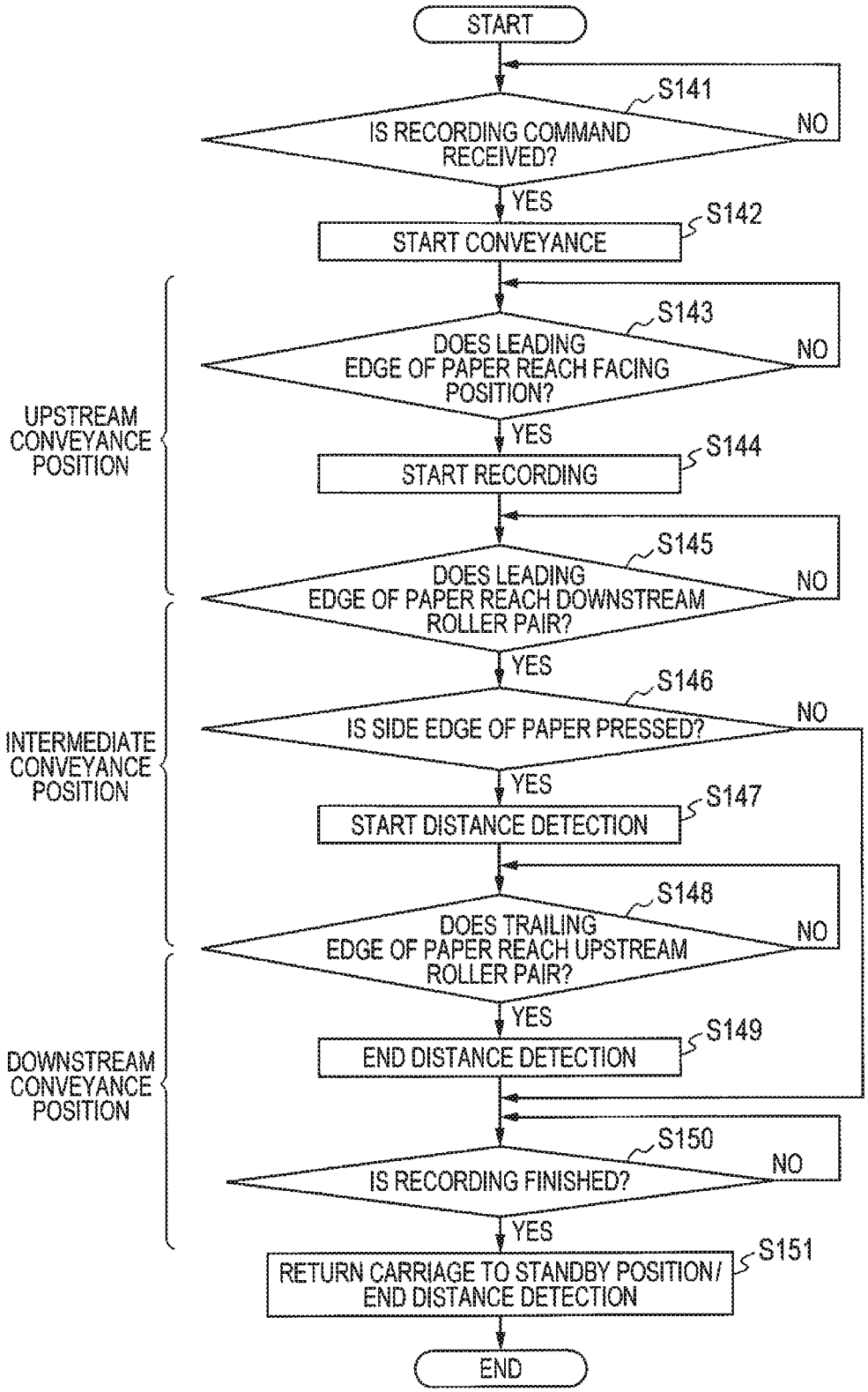
FIG. 17 is a flowchart showing control details relating to recording in an eighth embodiment of this disclosure.

Next, an eighth embodiment of this disclosure will be described with reference to FIG. 17. The printer of the eighth embodiment has the same configuration as the printer of the sixth embodiment except that a position used as a determination condition for determining whether to perform distance detection is different from that of the printer of the sixth embodiment.

In the sixth embodiment, whether to perform distance detection is determined depending on positional relationships of the upstream roller pair 41 and the downstream roller pairs 42 with the leading edge and the trailing edge of the paper P. On the other hand, in the present embodiment, whether to perform distance detection is determined depending on whether the side edge of the paper P is pressed by the corrugation plates 51 at the time of image recording on the paper P.

In detail, first, the CPU 91 performs the processing of S141 to S145 same as S101 to S105. Then, when the leading edge of the paper P reaches the downstream roller pairs 42 (S145: YES), based on information on a size of the paper P included in a received recording command, the CPU 91 determines whether the side edge of the paper P is pressed by the corrugation plates 51 at the time of image recording on the paper P (S146).

When the side edge of the paper P is pressed by the corrugation plates 51 at the time of image recording on the paper P (S146: YES), the CPU 91 starts distance detection as in S106 (S147). When the side edge of the paper P is not pressed by the corrugation plates 51 at the time of image recording on the paper P (S146: NO), the CPU 91 does not start distance detection, and advances the process to S150. After S147, the CPU 91 performs the processing of S148 to S151 same as S107 to S110, and ends this routine.

That is, in the present embodiment, when the side edge of the paper P is pressed by the corrugation plates 51 at the time of image recording on the paper P, the CPU 91 performs distance detection, and when the side edge of the paper P is not pressed by the corrugation plates 51 at the time of image recording on the paper P, the CPU 91 does not perform distance detection.

As described above, according to the present embodiment, the following effects are obtained, in addition to the same effects due to the same configuration as the first embodiment.

When the side edge of the paper P is not pressed by the corrugation plates 51, the vicinity of the side edge of the paper P does not receive pressing, so that it may float and approach the nozzle surface 11*a*. In this case, if the paper-nozzle distance is determined to be small and image recording is interrupted, the throughput is degraded. In this regard, in the present embodiment, when the side edge of the paper P is pressed by the corrugation plates 51, distance detection is performed, and when the side edge of the paper P is not pressed by the corrugation plates 51, distance detection is not performed. Therefore, when the side edge of the paper P is not pressed by the corrugation plates 51, the paper-nozzle distance is not determined to be small and image recording is not interrupted, and therefore, the throughput degradation is suppressed.

Ninth Embodiment

Next, a ninth embodiment of this disclosure will be described with reference to FIGS. 18 and 19. The printer of the ninth embodiment has the same configuration as the printer 100 of the first embodiment except that the target to change depending on the position of the paper P in the conveyance path R is different from that of the printer 100 of the first embodiment.

In the first embodiment, the recording interruption determination condition (threshold) is changed depending on a position of the paper P in the conveyance path R, however, in the present embodiment, a coefficient by which a value (A/D value) of an output signal is multiplied at the time of determination of recording interruption is changed depending on a position of the paper P in the conveyance path R. Coefficients Z1 to Z3 (Z1<Z2<Z3) are stored in the ROM 92 in the manufacturing process of the printer 100. The threshold is fixed (for example, the threshold Y2) regardless of a position of the paper P in the conveyance path R.

Figure 18:
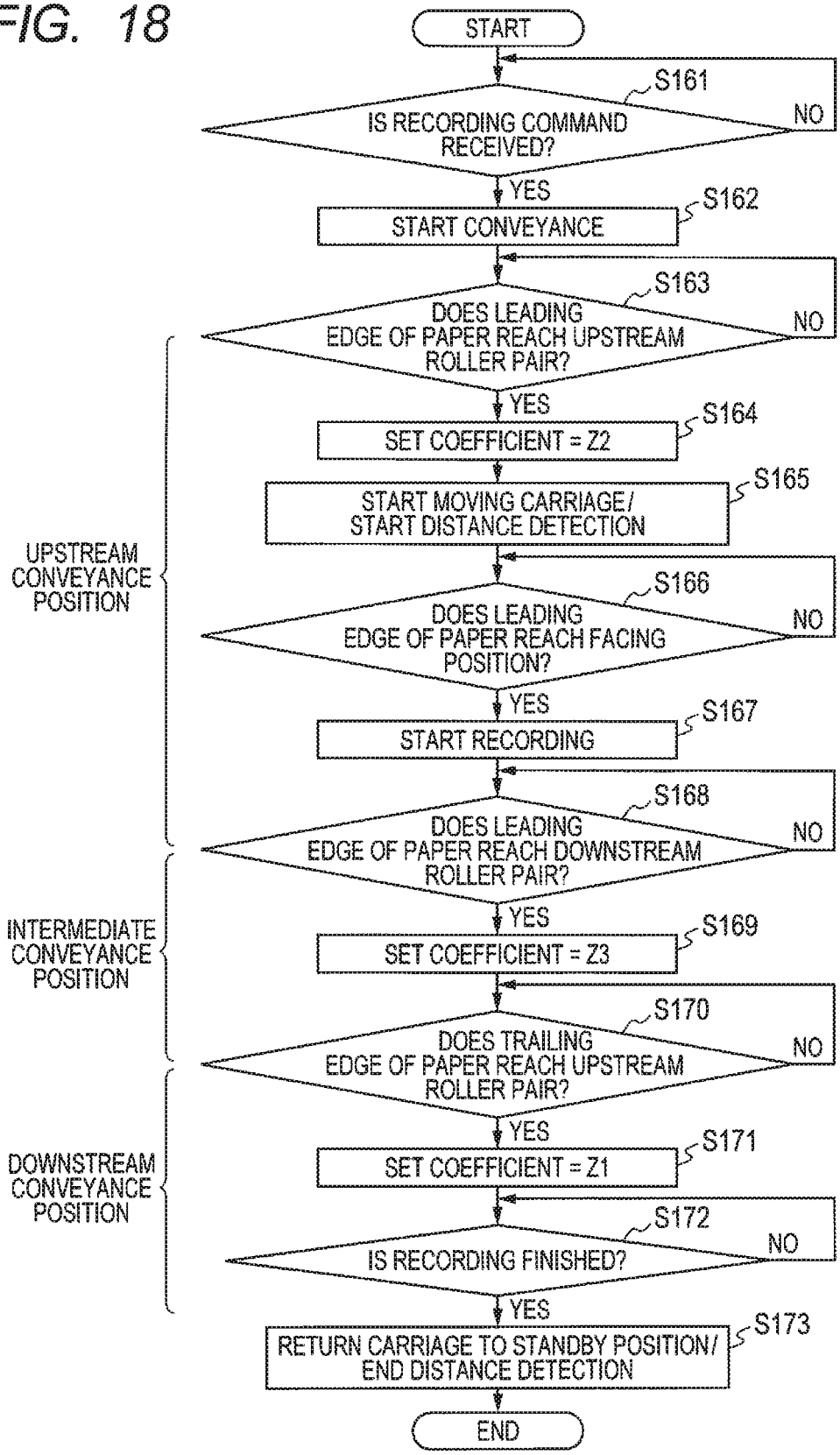
FIG. 18 is a flowchart showing control details relating to recording in a ninth embodiment of this disclosure.

In the present embodiment, the CPU 91 performs control relating to recording shown in FIG. 18. First, the CPU 91 performs the processing of S161 to S163 same as S1 to S3. Then, when the leading edge of the paper P reaches the upstream roller pair 41 (S163: YES), the CPU 91 sets the coefficient to Z2 (S164). After S164, the CPU 91 performs the processing of S165 to S168 same as S5 to S8. After S168, the CPU 91 sets the coefficient to Z3 (S169). After S169, the CPU 91 performs the processing of S170 same as S10. Then, when the trailing edge of the paper P reaches the upstream roller pair 41 (S170: YES), the CPU 91 sets the coefficient to Z1 (S171). After S171, the CPU 91 performs the processing of S172 and S173 same as S12 and S13, and ends this routine.

Figure 19:
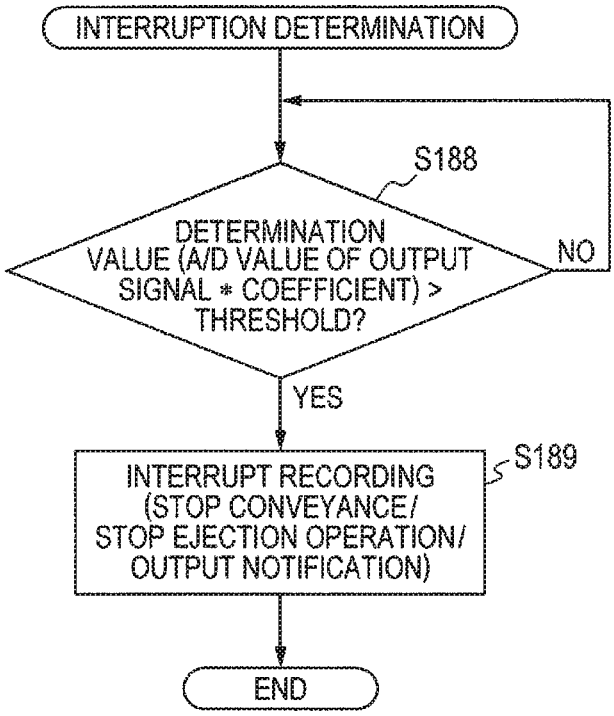
FIG. 19 is a flowchart showing recording interruption determination processing in the ninth embodiment of this disclosure.

During distance detection, the CPU 91 performs the recording interruption determination processing shown in FIG. 19. First, the CPU 91 determines whether a determination value (value obtained by multiplying an A/D value of an output signal received from the light reception element 7*b* by the set coefficient (Z1, Z2, or Z3)) has exceeded the threshold (S188). When the determination value does not exceed the threshold (S188: NO), the processing of S188 is repeated. When the determination value exceeds the threshold (S188: YES), the CPU 91 determines to interrupt image recording (S189). In S189, the CPU 91 performs a similar processing as that of S19. After S189, the CPU 91 ends this routine.

As described above, according to the present embodiment, a coefficient by which a value (A/D value) of an output signal is multiplied at the time of determination of recording interruption is changed depending on a position of the paper P in the conveyance path R. In this way, by performing appropriate processing depending on a position of the paper P in the conveyance path R, throughput degradation is suppressed.

The coefficient Z3 to be set when the paper P is located at the intermediate conveyance position is larger than the coefficient Z2 to be set when the paper P is located at the upstream conveyance position and the coefficient Z1 to be set when the paper P is located at the downstream conveyance position. Therefore, when the paper P is located at the intermediate conveyance position, even with the same A/D value, the determination value is larger than when the paper P is located at the upstream conveyance position or the downstream conveyance position, and the paper P is more securely prevented from coming into contact with the nozzle surface 11*a*.

The coefficient Z2 to be set when the paper P is located at the upstream conveyance position is larger than the coefficient Z1 to be set when the paper P is located at the downstream conveyance position. Therefore, when the paper P is located at the upstream conveyance position, even with the same A/D value, the determination value is larger than when the paper P is located at the downstream conveyance position, and the paper P is more securely prevented from coming into contact with the nozzle surface 11*a*.

Modification

While the disclosure has been described in detail with reference to the above aspects thereof, it would be apparent to those skilled in the art that various changes and modifications may be made therein without departing from the scope of the claims.

For example, two or more of the configurations of the above-described embodiments may be combined. For example, the controller may change the threshold depending on both of positional relationships of the upstream roller pair and the downstream roller pairs with the leading edge and the trailing edge of an ejection target, and whether a side edge of the ejection target is pressed by the pressing member at the time of recording. In this case, for example, the controller may set a threshold first by determining whether a side edge of an ejection target is pressed by the pressing member at the time of recording, and then, change the set threshold depending on a position change of the ejection target according to conveyance. In the eighth embodiment (FIG. 17), the controller changes a determination as to whether to perform distance detection depending on both of positional relationships of the upstream roller pair and the downstream roller pairs with a leading edge and a trailing edge of an ejection target, and whether a side edge of the ejection target is pressed by the pressing member at the time of recording, however, the controller may change the determination as to whether to perform distance detection depending on only one of the above-described conditions. In this case, for example, first, the controller determines whether to perform distance detection by judging whether the side edge of the ejection target is pressed by the pressing member at the time of recording. Then, regardless of a subsequent position change of the ejection target caused by conveyance, when the controller determines to perform distance detection, the controller may perform distance detection during recording, and when the controller determines not to perform distance detection, the controller may not perform distance detection during recording. Both of the determination condition (threshold in the embodiment described above) and the coefficient may be changed depending on a position of the ejection target in the conveyance path.

In the above-described embodiment, the distance sensor is disposed at upstream or downstream side of all nozzles formed on the nozzle surface in the conveyance direction, however, the disposition is not limited to this. For example, a part of the nozzles formed on the nozzle surface may be disposed at upstream or downstream side of the distance sensor in the conveyance direction. In addition, the distance sensor is not limited to being mounted on the carriage, and may be disposed on the nozzle surface of the head.

The characteristics of the distance sensor are not limited to those shown in FIG. 6. For example, in FIG. 6, the A/D value of the distance signal becomes smaller as the paper-nozzle distance becomes longer, however, the A/D value may become larger as the paper-nozzle distance becomes longer. In the embodiment described above, the A/D value of the distance signal changes according to the paper-nozzle distance, however, without limiting to this, an arbitrary element (for example, wavelength) of the distance signal may change according to the paper-nozzle distance. In this case, the controller may detect the paper-nozzle distance based on a change of the above-described element of the distance signal. The distance signal may include data quantifying the paper-nozzle distance.

The distance sensor is not limited to one in number. For example, when the liquid ejection head ejects liquids in a plurality of colors, the distance sensor may be provided for each color.

The distance sensor is not limited to an optical type, and may be an ultrasonic type, and so on. The distance sensor is not limited to a non-contact type, and may be a contact type.

In the embodiment described above, the rotary encoder is an example of the position sensor. The controller identifies a conveyance amount of an ejection target based on a signal output from the rotary encoder, and detects a position of the ejection target in the conveyance path based on the conveyance amount and a reference position in the conveyance path. That is, in the embodiment described above, based on a signal output from the position sensor, the controller indirectly detects a position of the ejection target in the conveyance path. However, without limiting to this, the controller may directly detect a position of the ejection target in the conveyance path based on a signal output from the position sensor. In this case, the position sensor may be, for example, a contact sensor and so on disposed so as to be contactable with the ejection target at a particular position in the conveyance path (for example, attached to rollers of the conveyer). The position sensor may output signals showing whether the ejection target is present at a plurality of positions in the conveyance path. Based on the signals, the controller determines the number of positions at which the ejection target has been detected to be present among the plurality of positions, and directly detects a position of the ejection target in the conveyance path.

In an embodiment in which control is performed by determining whether a side edge of an ejection target is pressed by the pressing member at the time of image recording on the ejection target from positional information (information included in a recording command, and so on), the position sensor may be omitted.

The pressing member is not limited to a plurality of plates, and may be one plate. The pressing member may be omitted.

Processing to be performed by the controller to interrupt image recording is not limited to conveyance stop, ejection operation stop, and notification, and may be, for example, processing to adjust the distance. When it is determined to interrupt image recording, the controller temporarily stops an operation relating to recording, and then may restart recording.

In the above-described embodiment, the CPU and the ASIC share the function of the controller, but is not limited to this. For example, only one of the CPU and ASIC may function as the controller, or a plurality of CPUs and/or a plurality of ASICs may share the function of the controller.

The conveyer is not limited to roller pairs, but may include a belt to support the ejection target medium. The conveyance direction is linear in the embodiment described above, but may be curved.

The liquid ejection head is not limited to a serial type, but may be a line type (that is, a type that ejects a liquid to a recording medium while being fixed in position). When the liquid ejection head is a line type, a distance sensor elongated in the scan direction or a plurality of sensors away from each other in the scan direction may be provided, or one distance sensor may be moved in the scan direction.

As an actuator to provide an energy to eject a liquid from the nozzles, a piezoelectric type is exemplified in the embodiment described above, however, without limiting to this, other types (for example, a thermal type using a heating element, an electrostatic type using an electrostatic force, and so on) may be used.

A liquid to be ejected from the nozzles is not limited to a dye ink, but may be a pigment ink. When a liquid to be ejected from the nozzles is a pigment ink, for example, preferably, a plurality of light emission elements that emit lights of mutually different colors are provided, and in distance detection, a light emission element that emits light in a color opposite to a color of the ink in a hue circle is selected among the plurality of light emission elements, and from this light emission element, light is irradiated onto the surface of the ejection target. This suppresses a problem in which a difference in reflected light amount between a region in which the ink has landed and a region in which the ink has not landed on the surface of the ejection target increases. The liquid to be ejected from the nozzles is not limited to ink, but may be an arbitrary liquid (for example, a processing liquid that aggregates or precipitates components in the ink, and so on).

The ejection target is not limited to a sheet of paper, but may be, for example, cloth or an electronic substrate (base material to form a flexible printed board, and so on).

This disclosure is applicable not only to a printer but also to a facsimile machine, a copying machine, a multifunction peripheral, and so on.

What is claimed is:

1. A liquid ejection apparatus comprising:

a liquid ejection head having a nozzle surface formed with a nozzle configured to eject liquid;

a conveyer configured to convey an ejection target in a conveyance direction along a conveyance path including a facing position facing the nozzle surface;

a distance sensor configured to output a distance signal that changes depending on a distance between the nozzle surface and a surface of the ejection target; and a controller configured to perform:

receiving the distance signal outputted from the distance sensor and positional information relating to a position of the ejection target on the conveyance path; and during ejecting liquid from the nozzle to record an image on the ejection target, changing at least one of a determination condition and a coefficient based on the positional information, the determination condition being a condition for determining whether to interrupt recording of the image by referring to the distance signal, the coefficient being multiplied by a value of the distance signal when determining whether to interrupt recording.

2. The liquid ejection apparatus according to claim 1, wherein the conveyer includes:

an upstream roller pair disposed at an upstream side of the nozzle in the conveyance direction; and a downstream roller pair disposed at a downstream side of the nozzle in the conveyance direction;

wherein the position includes:

an upstream conveyance position at which a leading edge of the ejection target conveyed by the conveyer is located between the upstream roller pair and the downstream roller pair and at which a trailing edge of the ejection target is located at an upstream side of the upstream roller pair in the conveyance direction; and an intermediate conveyance position at which the leading edge of the ejection target is located at a downstream side of the downstream roller pair in the conveyance direction and at which the trailing edge of the ejection target is located at an upstream side of the upstream roller pair in the conveyance direction;

wherein the determination condition includes:

an upstream conveyance determination condition used under a condition that the ejection target is located at the upstream conveyance position; and an intermediate conveyance determination condition used under a condition that the ejection target is located at the intermediate conveyance position;

wherein a value of the upstream conveyance determination condition and a value of the intermediate conveyance determination condition correspond to the distance; and wherein the distance corresponding to the value of the intermediate conveyance determination condition is longer than the distance corresponding to the value of the upstream conveyance determination condition.

3. The liquid ejection apparatus according to claim 2, wherein the position further includes:

a downstream conveyance position at which the leading edge of the ejection target is located at a downstream side of the downstream roller pair in the conveyance direction and at which the trailing edge of the ejection target is located between the upstream roller pair and the downstream roller pair;

wherein the determination condition further includes:

a downstream conveyance determination condition used under a condition that the ejection target is located at the downstream conveyance position;

wherein a value of the downstream conveyance determination condition corresponds to the distance; and wherein the distance corresponding to the value of the upstream conveyance determination condition is longer than the distance corresponding to the value of the downstream conveyance determination condition.

4. The liquid ejection apparatus according to claim 3, wherein an interval between the upstream roller pair and the distance sensor in the conveyance direction is smaller than an interval between the downstream roller pair and the distance sensor in the conveyance direction; and wherein the nozzle surface has the nozzle disposed at a downstream side of the distance sensor in the conveyance direction.

5. The liquid ejection apparatus according to claim 2, wherein the position further includes:

a downstream conveyance position at which the leading edge of the ejection target is located at a downstream side of the downstream roller pair in the conveyance direction and at which the trailing edge of the ejection target is located between the upstream roller pair and the downstream roller pair;

wherein the determination condition further includes:

a downstream conveyance determination condition used under a condition that the ejection target is located at the downstream conveyance position;

wherein a value of the downstream conveyance determination condition corresponds to the distance;

wherein an interval between the upstream roller pair and the distance sensor in the conveyance direction is larger than an interval between the downstream roller pair and the distance sensor in the conveyance direction;

wherein the nozzle surface has the nozzle disposed at an upstream side of the distance sensor in the conveyance direction; and wherein the distance corresponding to the value of the downstream conveyance determination condition is longer than the distance corresponding to the value of the upstream conveyance determination condition.

6. The liquid ejection apparatus according to claim 1, wherein the conveyer includes:

an upstream roller pair disposed at an upstream side of the nozzle in the conveyance direction; and a downstream roller pair disposed at a downstream side of the nozzle in the conveyance direction;

wherein the position includes:

a downstream conveyance position at which a leading edge of the ejection target conveyed by the conveyer is located at a downstream side of the downstream roller pair in the conveyance direction and at which a trailing edge of the ejection target is located between the upstream roller pair and the downstream roller pair; and an intermediate conveyance position at which the leading edge of the ejection target is located at a downstream side of the downstream roller pair in the conveyance direction and at which the trailing edge of the ejection target is located at an upstream side of the upstream roller pair in the conveyance direction;

wherein the determination condition includes:

a downstream conveyance determination condition used under a condition that the ejection target is located at the downstream conveyance position; and an intermediate conveyance determination condition used under a condition that the ejection target is located at the intermediate conveyance position;

wherein a value of the downstream conveyance determination condition and a value of the intermediate conveyance determination condition correspond to the distance; and wherein the distance corresponding to the value of the intermediate conveyance determination condition is longer than the distance corresponding to the value of the downstream conveyance determination condition.

7. The liquid ejection apparatus according to claim 1, wherein the conveyer includes:

an upstream roller pair disposed at an upstream side of the nozzle in the conveyance direction; and a downstream roller pair disposed at a downstream side of the nozzle in the conveyance direction;

wherein the liquid ejection apparatus further comprises:

a pressing member configured to press the surface of the ejection target at a pressing position that is located at an upstream side of the nozzle in the conveyance direction and at a downstream side of the upstream roller pair in the conveyance direction;

wherein the position includes:

an upstream pressing position at which a leading edge of the ejection target conveyed by the conveyer is located between the pressing position and the downstream roller pair and at which a trailing edge of the ejection target is located at an upstream side of the pressing position in the conveyance direction; and an intermediate pressing position at which the leading edge of the ejection target is located at a downstream side of the downstream roller pair in the conveyance direction and at which the trailing edge of the ejection target is located at an upstream side of the pressing position in the conveyance direction;

wherein the determination condition includes:

an upstream pressing determination condition used under a condition that the ejection target is located at the upstream pressing position; and an intermediate pressing determination condition used under a condition that the ejection target is located at the intermediate pressing position;

wherein a value of the upstream pressing determination condition and a value of the intermediate pressing determination condition correspond to the distance; and wherein the distance corresponding to the value of the intermediate pressing determination condition is longer than the distance corresponding to the value of the upstream pressing determination condition.

8. The liquid ejection apparatus according to claim 7, wherein the position further includes:

a downstream pressing position at which the leading edge of the ejection target is located at a downstream side of the downstream roller pair in the conveyance direction and at which the trailing edge of the ejection target is located between the pressing position and the downstream roller pair; and wherein the determination condition further includes:

a downstream pressing determination condition used under a condition that the ejection target is located at the downstream pressing position;

wherein a value of the downstream pressing determination condition corresponds to the distance; and wherein the distance corresponding to the value of the upstream pressing determination condition is longer than the distance corresponding to the value of the downstream pressing determination condition.

9. The liquid ejection apparatus according to claim 8, wherein an interval between the pressing position and the distance sensor in the conveyance direction is smaller than an interval between the downstream roller pair and the distance sensor in the conveyance direction; and wherein the nozzle surface has the nozzle disposed at a downstream side of the distance sensor in the conveyance direction.

10. The liquid ejection apparatus according to claim 7, wherein the position further includes:

a downstream pressing position at which the leading edge of the ejection target is located at a downstream side of the downstream roller pair in the conveyance direction and at which the trailing edge of the ejection target is located between the pressing position and the downstream roller pair; and wherein the determination condition further includes:

a downstream pressing determination condition used under a condition that the ejection target is located at the downstream pressing position;

wherein a value of the downstream pressing determination condition corresponds to the distance;

wherein an interval between the pressing position and the distance sensor in the conveyance direction is larger than an interval between the downstream roller pair and the distance sensor in the conveyance direction;

wherein the nozzle surface has the nozzle disposed at an upstream side of the distance sensor in the conveyance direction; and wherein the distance corresponding to the value of the downstream pressing determination condition is longer than the distance corresponding to the value of the upstream pressing determination condition.

11. The liquid ejection apparatus according to claim 7, further comprising:

a pressing member configured to press the surface of the ejection target at a pressing position that is located at an upstream side of the nozzle in the conveyance direction;

wherein the controller is configured to determine, based on the positional information, whether a side edge of the ejection target is pressed by the pressing member when an image is recorded on the ejection target, the side edge being an edge of the ejection target in a perpendicular direction perpendicular to the conveyance direction;

wherein the determination condition includes:

an edge pressing determination condition used under a condition that the side edge is pressed by the pressing member; and an edge no-pressing determination condition used under a condition that the side edge is not pressed by the pressing member; and wherein the distance corresponding to the value of the edge pressing determination condition is longer than the distance corresponding to the value of the edge no-pressing determination condition.

12. The liquid ejection apparatus according to claim 1, wherein the conveyer includes:

an upstream roller pair disposed at an upstream side of the nozzle in the conveyance direction; and a downstream roller pair disposed at a downstream side of the nozzle in the conveyance direction;

wherein the liquid ejection apparatus further comprises:

a pressing member configured to press the surface of the ejection target at a pressing position that is located at an upstream side of the nozzle in the conveyance direction and at a downstream side of the upstream roller pair in the conveyance direction;

wherein the position includes:

a downstream pressing position at which a leading edge of the ejection target conveyed by the conveyer is located at a downstream side of the downstream roller pair in the conveyance direction and at which a trailing edge of the ejection target is located between the pressing position and the downstream roller pair; and an intermediate pressing position at which the leading edge of the ejection target is located at a downstream side of the downstream roller pair in the conveyance direction and at which the trailing edge of the ejection target is located at an upstream side of the pressing position in the conveyance direction;

wherein the determination condition includes:

a downstream pressing determination condition used under a condition that the ejection target is located at the downstream pressing position; and an intermediate pressing determination condition used under a condition that the ejection target is located at the intermediate pressing position;

wherein a value of the downstream pressing determination condition and a value of the intermediate pressing determination condition correspond to the distance; and wherein the distance corresponding to the value of the intermediate pressing determination condition is longer than the distance corresponding to the value of the downstream pressing determination condition.

13. The liquid ejection apparatus according to claim 1, further comprising a carriage on which the liquid ejection head is mounted, wherein the controller is configured to:

during image recording, alternately perform: a conveyance operation of controlling the conveyer to convey the ejection target by a particular amount in the conveyance direction; and an ejection operation of ejecting liquid from the nozzle while moving the carriage in a perpendicular direction perpendicular to the conveyance direction; and when interrupting image recording, stop the ejection operation.

14. The liquid ejection apparatus according to claim 1, further comprising a notification device, wherein the controller is configured to, when interrupting image recording, control the notification device to output a notification.

* * * * *